US010086615B2

(12) United States Patent
Nakano

(10) Patent No.: US 10,086,615 B2
(45) Date of Patent: Oct. 2, 2018

(54) NOZZLE SURFACE WIPING DEVICE, LIQUID DISCHARGE APPARATUS, AND HEAD CLEANING METHOD

(71) Applicant: FUJIFILM Corporation, Tokyo (JP)

(72) Inventor: Takuma Nakano, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/597,155

(22) Filed: May 17, 2017

(65) Prior Publication Data

US 2017/0334209 A1 Nov. 23, 2017

(30) Foreign Application Priority Data

May 19, 2016 (JP) ..... 2016-100205

(51) Int. Cl.
*B41J 2/165* (2006.01)

(52) U.S. Cl.
CPC ..... *B41J 2/16538* (2013.01); *B41J 2/16532* (2013.01)

(58) Field of Classification Search
CPC .... B41J 2002/16558; B41J 2002/16552; B41J 2/16502–2/16579
See application file for complete search history.

(56) References Cited

U.S. PATENT DOCUMENTS 5,969,731 A * 10/1999 Michael ..... B41J 2/16535 347/33
8,002,382 B2 * 8/2011 Steinfield ..... B41J 2/16535 347/33
8,931,868 B2 1/2015 Fukuda et al.
9,296,211 B2 3/2016 Ozaki
2012/0194610 A1 * 8/2012 Kyoso ..... B41J 2/16535 347/33
2012/0218346 A1 * 8/2012 Inoue ..... B41J 2/16552 347/33
2013/0176362 A1 * 7/2013 Inoue ..... B41J 2/16535 347/33

(Continued)

FOREIGN PATENT DOCUMENTS

JP 2005161129 6/2005
JP 2014073627 4/2014

(Continued)

*Primary Examiner* — Patrick King
(74) *Attorney, Agent, or Firm* — JCIPRNET

(57) ABSTRACT

A nozzle surface wiping device capable of using a plurality of types of wiping members in a state where discharge deterioration is suppressed regarding the respective wiping members is provided. In the nozzle surface wiping device that wipes a nozzle surface of a liquid discharge head with a wiping member to which a cleaning liquid is applied, information on cleaning liquid application conditions for applying respective saturated liquid amounts of the cleaning liquid to a plurality of types of wiping members, respectively, according to the types of the respective wiping members is held in advance. The type of a wiping member to be used for the wiping of the nozzle surface of the liquid discharge head is specified, and a saturated liquid amount of the cleaning liquid is applied to the wiping member according to the determined cleaning liquid application conditions corresponding to the type of the specified wiping member.

11 Claims, 27 Drawing Sheets

(56) References Cited

U.S. PATENT DOCUMENTS

| | | | | |
|---|---|---|---|---|
| 2014/0198156 | A1* | 7/2014 | Murayama | B41J 2/16535 347/33 |
| 2015/0191018 | A1* | 7/2015 | Ozaki | B41J 2/16588 347/33 |
| 2016/0031220 | A1* | 2/2016 | Murayama | B41J 2/16544 347/33 |
| 2016/0121614 | A1* | 5/2016 | Shinoto | B41J 2/16535 347/5 |

FOREIGN PATENT DOCUMENTS

| | | |
|---|---|---|
| JP | 2014168853 | 9/2014 |
| JP | 2014188829 | 10/2014 |
| JP | 2015039781 | 3/2015 |

* cited by examiner

FIG. 7

| HYPOTHESIS | PRINCIPLE | OCCURRING PHENOMENON |
|---|---|---|
| FOREIGN MATTER PUSHING THEORY | FOREIGN MATTER IS PRESENT IN A WEB, AND THE FOREIGN MATTER IS PUSHED INTO A NOZZLE | BJ DETERIORATION. SPLASH OCCURS |
| BUBBLE ENTRAINMENT THEORY | BUBBLES ARE ENTRAINED IN A NOZZLE | BJ DETERIORATION. NON-DISCHARGE INCREASES |
| INK DRAWING-OUT THEORY | INK IS EXCESSIVELY DRAWN OUT, AND THE VICINITY OF A NOZZLE IS SOILED | $\sigma$ DETERIORATION. DISCHARGE BENDS TO A DOWNSTREAM SIDE IN A WIPING DIRECTION |
| MENISCUS COLLAPSE THEORY | INK IS EXCESSIVELY SUCKED OUT, AND A MENISCUS IS COLLAPSED | $\sigma$ DETERIORATION. DISCHARGE BENDS RANDOMLY |

| web TYPE | web FEED SPEED [mm/s] | LIQUID DROPPING SPEED [ml/min.] |
|---|---|---|
| web0 | 3.2 | 2.8 |
| web1 | 3.2 | 3.5 |
| web2 | 3.2 | 9.6 |

FIG. 20

| web | AMOUNT OF CLEANING LIQUID | NUMBER OF OUTPUT SHEETS [SHEETS] | n NUMBER | NUMBER OF GENERATED SINGLE STRIPES [PIECES/120 SHEETS] |
|---|---|---|---|---|
| web0 | STANDARD APPLICATION AMOUNT | 30 | 4 | 0 |
| web1 | STANDARD APPLICATION AMOUNT | 30 | 4 | 2 |
| | SATURATED LIQUID AMOUNT | 30 | 4 | 0 |

NOZZLE SURFACE WIPING DEVICE, LIQUID DISCHARGE APPARATUS, AND HEAD CLEANING METHOD

CROSS-REFERENCE TO RELATED APPLICATIONS

The present application claims priority under 35 U.S.C. § 119 to Japanese Patent Application No. 2016-100205, filed on May 19, 2016. The above application is hereby expressly incorporated by reference, in its entirety, into the present application.

BACKGROUND OF THE INVENTION

1. Field of the Invention

The present invention relates to a nozzle surface wiping device, a liquid discharge apparatus, and a head cleaning method, and particularly, to a head cleaning technique that wipes a nozzle surface of a liquid discharge head with a wiping member.

2. Description of the Related Art

In liquid discharge apparatuses including ink jet type liquid discharge heads, a discharge failure occurs if a nozzle surface of a liquid discharge head is soiled. For this reason, cleaning of the nozzle surface is performed regularly or irregularly. A head cleaning method that wipes the nozzle surface using a wiping member, such as a web, is known as one of the methods of cleaning the nozzle surface.

A method of applying a cleaning liquid to a wiping member to wipe a nozzle surface with the wiping member in a wet state is disclosed in JP2015-39781A, JP2014-188829A, JP2014-168853A, JP2014-73627A, and JP2005-161129A. "Ink jet heads" in Patent Document JP2015-39781A and JP2014-188829A are a term equivalent to "liquid discharge heads" in the present specification. An "ink discharge surface" in JP2015-39781A is a term equivalent to a "nozzle surface" in the present specification.

A "wiping web" in JP2014-188829A is a term equivalent to a "web" in the present specification. A "wiping member" in JP2014-168853A is a term equivalent to a "wiping member" in the present specification. A "wiping sheet" and "functional droplet discharge heads" in JP2005-161129A are respectively terms equivalent to the "wiping member" and the "liquid discharge heads" in the present specification.

SUMMARY OF THE INVENTION

There are various types of webs that are wiping members to be used for the wiping of a nozzle surface of a liquid discharge head. In liquid discharge apparatuses configured such that head cleaning is carried out using a certain specific type of web, if other types of web are adopted instead of the type of a web to be used, the other conditions are set to the same conditions, and the head cleaning is carried out, the discharge performance of the liquid discharge head may rather be deteriorated, and striped defects may be generated on a printed material. In the related art, causes of such discharge deterioration is not sufficiently verified, and alternatives of the types of available webs are limited.

The invention has been made in view of such circumstances, and an object thereof is to provide a nozzle surface wiping device, a liquid discharge apparatus, and a head cleaning method that can clarify conditions capable of using a plurality of types of wiping members in a state where discharge deterioration is suppressed regarding the respective wiping members, and can effectively use the plurality of types of wiping members.

The following invention aspects are provided as means for solving the problems.

A nozzle surface wiping device related to a first aspect of the present disclosure comprises cleaning liquid application means for applying a cleaning liquid to a wiping member that wipes a nozzle surface of a liquid discharge head; condition information holding means for holding, in advance, information on cleaning liquid application conditions for applying respective saturated liquid amounts of the cleaning liquid to a plurality of types of the wiping members, respectively, according to types of the wiping members; type specifying means for specifying the type of a wiping member to be used for the wiping of the nozzle surface; and control means for controlling the amount of the cleaning liquid to be applied to the wiping member according to the type of the wiping member specified by the type specifying means. The control means performs a control of determining the cleaning liquid application conditions corresponding to the type of the wiping member to be used for the wiping of the nozzle surface, on the basis of the type of the wiping member specified by the type specifying means and the information held in the condition information holding means, and applies a saturated liquid amount of the cleaning liquid to the wiping member according to the determined cleaning liquid application conditions.

According to the experiment that the inventor conducted, it is considered that the discharge deterioration accompanying a change in the type of the wiping member to be used is caused by the liquid being excessively sucked out of the nozzle by the wiping member that has come into contact with the nozzle surface and a meniscus within the nozzle being collapsed. On the basis of this knowledge, in the nozzle surface wiping device related to the first aspect, the cleaning liquid application conditions for applying the respective saturated liquid amounts of the cleaning liquid to the plurality of types of wiping members, respectively, are determined in advance, and according to the type of a wiping member to be used, the amount of the cleaning liquid is controlled such that the saturated liquid amount of the cleaning liquid is applied to the wiping member. Accordingly, sucking-off of the liquid from the nozzle by the wiping member is suppressed, and breaking of the meniscus within the nozzle can be prevented. According to the first aspect, the plurality of types of wiping members can be used properly, and the range of alternatives of the available wiping members is broadened.

As a second aspect, in the nozzle surface wiping device of the first aspect, it is possible to adopt a configuration in which the wiping member is a beltlike web, the nozzle surface wiping device further comprises web transporting means for making the web travel in a longitudinal direction of the web, and the nozzle surface is wiped by relatively moving the wiping member and the liquid discharge head while the wiping member to which the saturated liquid amount of the cleaning liquid is applied is made to travel with the web transporting means.

As a third aspect, in the nozzle surface wiping device of the second aspect, it is possible to adopt a configuration in which, in a case where a feed speed of the web by the web transporting means is defined as v millimeters per second, a feed time of the web by the web transporting means is defined as t seconds, a web width in a width direction orthogonal to the longitudinal direction of the web is defined w millimeters, a saturated absorbed liquid amount per unit area of the web is defined as C milliliters per square millimeters, and an application amount of the cleaning liquid by the cleaning liquid application means is defined as L milliliters, the control means performs a control of being the application amount of the cleaning liquid that satisfies $L \geq v \times t \times w \times C$.

According to the third aspect, even in a case where the feed speed of the web is changed, a suitable amount of the cleaning liquid can be applied to each type of wiping member, and the effect of the wiping can be maintained.

As a fourth aspect, in the nozzle surface wiping device of the second aspect or the third aspect, it is possible to adopt a configuration in which the information on the cleaning liquid application conditions includes information that determines a feed speed of the web by the web transporting means, and a liquid supply amount per unit time of the cleaning liquid to be supplied from the cleaning liquid application means to the web.

As a fifth aspect, it is possible to adopt a configuration in which the nozzle surface wiping device of any one aspect of the second aspect to the fourth aspect further comprises a winding shaft that winds the web by being rotationally driven. The web has feed holes for transportation in the longitudinal direction, at an end part in a width direction orthogonal to the longitudinal direction, and the winding shaft has a concavo-convex structure including protrusions to be engaged with respect to the feed holes.

According to the fifth aspect, the web wetted in a saturated state can be transported reliably, and occurrence of transportation problems caused by sticking or slipping of the web by the cleaning liquid can be suppressed.

As a sixth aspect, in the nozzle surface wiping device of the fifth aspect, it is possible to adopt a configuration in which a shaft part between the concavo-convex structures that are respectively provided at end parts on both sides in the width direction of the winding shaft has a non-contact portion that is in non-contact with the web, and the non-contact portion has a smaller diameter than recesses of the concavo-convex structures that comes into contact with the webs.

By forming the non-contact portion such that the contact area of the shaft part with the web becomes small, sticking of the web can be suppressed. According to the sixth aspect, the web feed can be carried out reliably.

As a seventh aspect, in the nozzle surface wiping device of the fifth aspect or the sixth aspect, it is possible to adopt a configuration in which the feed holes are formed in two rows at each of the end parts on both sides in the width direction of the web, and two rows of the concavo-convex structures are formed at each of the end parts on both sides in the winding shaft.

According to the seventh aspect, the force of transporting the web becomes much larger, and the web feed can be carried out reliably.

As an eighth aspect, in the nozzle surface wiping device of any one aspect of the first aspect to the seventh aspect, it is possible to adopt a configuration in which the cleaning liquid application means includes a cleaning liquid supply nozzle that adds the cleaning liquid dropwise onto the wiping member, and a tube pump that supplies the cleaning liquid to the cleaning liquid supply nozzle, and the control means controls a dropping amount per unit time of the cleaning liquid that is added dropwise from the cleaning liquid supply nozzle by controlling a voltage that drives the tube pump.

As a ninth aspect, in the nozzle surface wiping device of any one aspect of the first aspect to the eighth aspect, it is possible to adopt a configuration in which the type specifying means includes selecting and operating means for selecting the type of a wiping member to be used for the wiping of the nozzle surface from the plurality of types of wiping members that are prepared in advance, and the control means determines the corresponding cleaning liquid application conditions from the information holding the condition information holding means, on the basis of the type of the wiping member selected by the selecting and operating means.

A liquid discharge apparatus related to a tenth aspect comprises the nozzle surface wiping device according to any one of the first aspect to the ninth aspect; the liquid discharge head having the nozzle surface where openings of a plurality of nozzles that discharge a liquid are arrayed; and relative movement means for relatively moving the liquid discharge head and the wiping member in a state where the nozzle surface and the wiping member come in contact with each other.

A head cleaning method related to an eleventh aspect is a head cleaning method of wiping a nozzle surface of a liquid discharge head with a wiping member. The method comprises a condition information holding step of determining cleaning liquid application conditions for applying respective saturated liquid amounts of a cleaning liquid to a plurality of types of the wiping members, respectively, according to types of the wiping members in advance, and of holding information on the cleaning liquid application conditions according to the types of the wiping members; a type specifying step of specifying the type of a wiping member to be used for the wiping of the nozzle surface; a condition determination step of determining the cleaning liquid application conditions corresponding to the type of the wiping member specified by the type specifying step; a cleaning liquid application step of applying a saturated liquid amount of the cleaning liquid to the wiping member according to the cleaning liquid application conditions determined by the condition determination step; and a wiping step of bringing the wiping member, in a state where the saturated liquid amount of the cleaning liquid is applied thereto, into contact with the nozzle surface, thereby wiping the nozzle surface.

In the eleventh aspect, the same items as the items specified in the second aspect to the ninth aspect can be combined appropriately. In that case, an element of means or a function to be specified in the nozzle surface wiping device can be ascertained as an element of a step of processing or operation corresponding thereto.

According to the invention, the plurality of types of wiping members can be used in a state where discharge deterioration is suppressed regarding the respective wiping members.

BRIEF DESCRIPTION OF THE DRAWINGS

FIG. 7 is a summarized chart of the outline of hypotheses and mechanisms regarding the causes of discharge deterioration by the head cleaning.

FIG. 20 is a chart illustrating evaluation results of stripes in a printed material after the head cleaning.

DESCRIPTION OF THE PREFERRED EMBODIMENTS

Hereinafter, an embodiment of the invention will be described in detail according to the accompanying drawings.

Configuration Example of Liquid Discharge Apparatus

Figure 1:
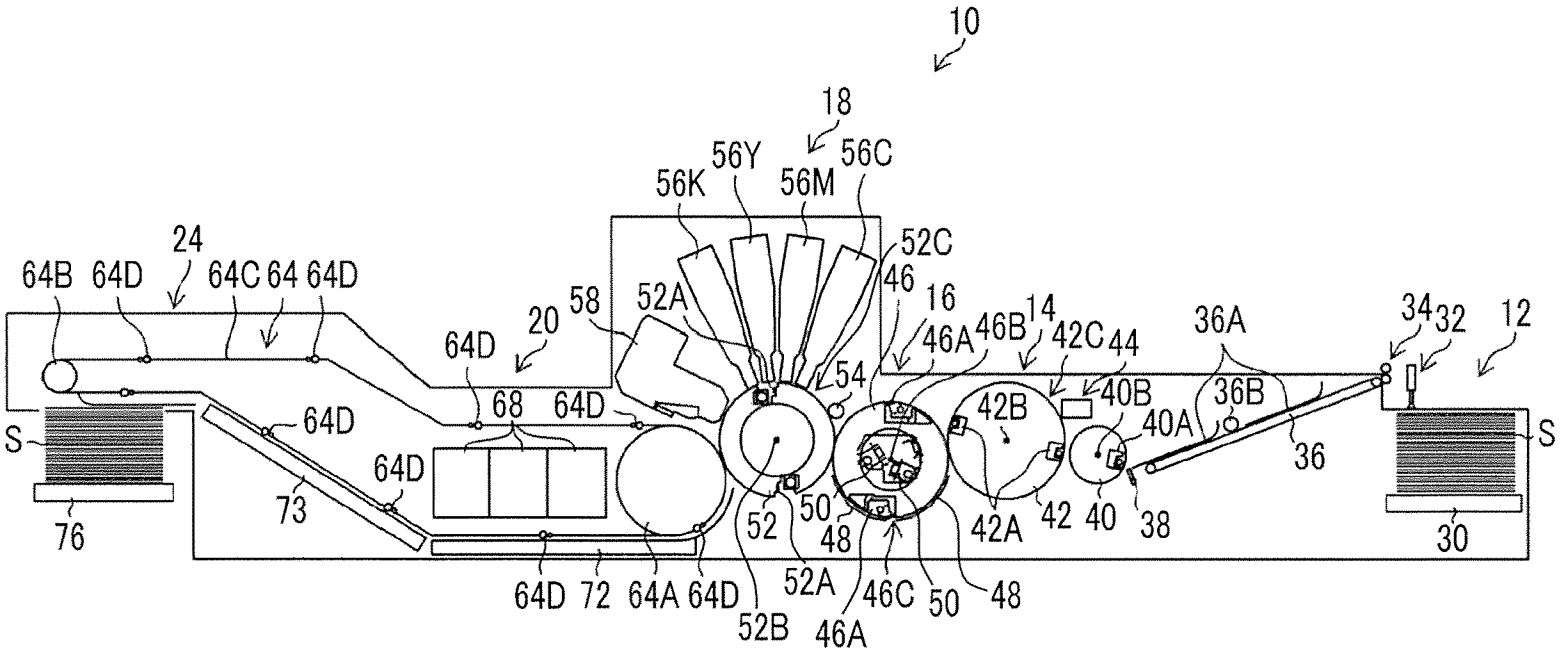
FIG. 1 is an overall configuration view of an ink jet recording device.

First, an overall configuration of a liquid discharge apparatus will be described. In present disclosure, an ink jet recording device that is one form of a liquid discharge apparatus is exemplified. FIG. 1 is an overall configuration view of the ink jet recording device. The ink jet recording device 10 is an image forming device that draws an image on a sheet of paper S using ink. The paper S is one form of a medium to be used as image formation.

The ink jet recording device 10 includes a paper feed unit 12, a treatment liquid application unit 14, a treatment liquid drying processing unit 16, a drawing unit 18, an ink drying processing unit 20, and a paper ejection unit 24.

Paper Feed Unit

The paper feed unit 12 includes a paper feed platform 30, a paper feeder 32, a paper feed roller pair 34, a feeder board 36, a front pad 38, and a paper feed barrel 40. The paper S stacked on the paper feed platform 30 is pulled up sheet by sheet sequentially from the top by the suction fit of the paper feeder 32, and is fed to the paper feed roller pair 34. The paper S fed to the paper feed roller pair 34 is sent out in a paper transporting direction by the paper feed roller pair 34, and is placed on the feeder board 36. The paper S placed on the feeder board 36 is pressed against a transporting surface of the feeder board 36 by a retainer 36A and a guide roller 36B in a transportation process by the feeder board 36, and irregularities are corrected.

The paper S transported by the feeder board 36 is corrected inclination by a leading end thereof abutting against the front pad 38. Thereafter, the paper S is transferred to the paper feed barrel 40.

The paper feed barrel 40 has a cylindrical shape having a direction parallel to a rotating shaft 40B as a longitudinal direction. The paper feed barrel 40 has a length exceeding the total length of the paper S in the longitudinal direction. The direction of the rotating shaft 40B of the paper feed barrel 40 is a direction passing through the paper plane of FIG. 1.

The paper feed barrel 40 is provided with a gripper 40A. The gripper 40A is gripping means for gripping a leading end part of the paper S. The gripper 40A is configured to include a plurality of claws, a claw platform, and a gripper shaft. Illustration of the plurality of claws, the claw platform, and the gripper shaft is omitted.

The plurality of claws of the gripper 40A are disposed in the direction parallel to the rotating shaft 40B of the paper feed barrel 40. Base end parts of the plurality of claws are rockably supported by the gripper shaft. The arrangement intervals of the plurality of claws and the length of a region where the plurality of claws are disposed are determined according to the size of the paper S. The claw platform is a member having the direction parallel to the rotating shaft 40B of the paper feed barrel 40 as a longitudinal direction. The length of the claw platform in the longitudinal direction of the paper feed barrel 40 is equal to or larger than the length of the region where the plurality of claws are disposed. The claw platform is disposed at a position that faces at tip parts of the plurality of claws.

The paper S transferred from the feeder board 36 to the paper feed barrel 40 has the leading end part gripped by the gripper 40A of the paper feed barrel 40, and is transported to the treatment liquid application unit 14.

Treatment Liquid Application Unit

The treatment liquid application unit 14 is means for applying a treatment liquid to a recording surface of the paper S. The treatment liquid application unit 14 is configured to include a treatment liquid barrel 42 and a treatment liquid applicator 44. The treatment liquid contains a component that a color material in ink is aggregated or improved in viscosity. A method of aggregating or viscosity-improving the color material may include, specifically, a method using a treatment liquid that reacts with ink to precipitate or insolubilize a color material in the ink, a method using a treatment liquid that creates gel that is a semi-solid substance including a color material in ink, or the like. As means for triggering a reaction between the ink and the treatment liquid, there is, for example, a method of reacting an anionic color material in ink with a cationic compound in a treatment liquid, a method of mixing a treatment liquid and ink having different PHs (pH; potential of hydrogen) from each other, thereby changing pH of ink to cause dispersion breaking of a pigment in the ink to aggregate the pigment, a method of causing dispersion breaking of a pigment in ink due to a reaction with polyvalent metallic salt in a treatment liquid, to aggregate the pigment, or the like.

The treatment liquid barrel 42 has a diameter twice as large as the diameter of the paper feed barrel 40. Grippers 42A are disposed in two places in a circumferential direction in the treatment liquid barrel 42. The arrangement positions of the two grippers 42A are positions that deviate by half of the circumference on an outer peripheral surface 42C of the treatment liquid barrel 42. As the configuration of the grippers 42A, the same configuration as the gripper 40A of the paper feed barrel 40 can be adopted.

The treatment liquid barrel 42 has a configuration in which the paper S is fixed to the outer peripheral surface 42C on which the paper S is supported. An example of the configuration in which the paper S is fixed to the outer peripheral surface 42C of the treatment liquid barrel 42 includes a configuration in which a plurality of suction holes are provided in the outer peripheral surface 42C of the treatment liquid barrel 42 and a negative pressure is exerted on the plurality of suction holes. As the configuration other than the above configuration in the treatment liquid barrel 42, the same configuration as the paper feed barrel 40 can be applied. Reference sign 42B designates a rotating shaft of the treatment liquid barrel 42.

A roller coating method can be applied to the treatment liquid applicator 44. As the roller coating type treatment liquid applicator 44, a configuration in which a treatment liquid tank, a metering roller, and a coating roller are provided can be adopted. Illustration of the treatment liquid tank, the metering roller, and the coating roller is omitted.

The treatment liquid supplied from the treatment liquid tank via a treatment liquid supply system is stored in the treatment liquid tank. Illustration of the treatment liquid supply system and the treatment liquid tank is omitted. The metering roller meters the treatment liquid stored in the treatment liquid tank. The metering roller transfers the metered treatment liquid to the coating roller. The coating roller coats, the treatment liquid on the paper S.

In addition, the configuration of the treatment liquid applicator 44 described herein is just an example, and other methods may be applied to the treatment liquid applicator 44. Additionally, other configurations may be applied to the treatment liquid applicator 44. An example of other types of the treatment liquid applicator 44 includes coating using a blade, discharge using an ink jet method, or spray using a spray method.

By rotating the treatment liquid barrel 42 in a state where the leading end of the paper S is gripped by the grippers 42A, the paper S is transported along the outer peripheral surface of the treatment liquid barrel 42. The treatment liquid is applied to the paper S transported along the outer peripheral surface of the treatment liquid barrel 42 by the treatment liquid applicator 44. The paper S to which the treatment liquid is applied is sent to the treatment liquid drying processing unit 16.

Treatment Liquid Drying Processing Unit

The treatment liquid drying processing unit 16 includes a treatment liquid drying processing barrel 46, a paper transportation guide 48, and the treatment liquid drying processing unit 50. The treatment liquid drying processing unit 16 performs drying processing on the paper S to which the treatment liquid is applied. The treatment liquid drying processing barrel 46 has the same diameter as that of the treatment liquid barrel 42, and grippers 46A are disposed in two places in the circumferential direction, similar to the treatment liquid barrel 42. As the configuration of the grippers 46A, the same configuration as that of the gripper 40A of the paper feed barrel 40 can be adopted. Reference sign 46B designates a rotating shaft of the treatment liquid drying processing barrel 46.

The paper transportation guide 48 is disposed at a position that faces an outer peripheral surface 46C of the treatment liquid drying processing barrel 46. The paper transportation guide 48 is disposed on a lower side of the treatment liquid drying processing barrel 46. The "lower side" in present specification is a gravitational direction side. An "upper side" is a side opposite to the gravitational direction.

The treatment liquid drying processing unit 50 is disposed inside the treatment liquid drying processing barrel 46. The treatment liquid drying processing unit 50 includes an air blowing unit that sends air toward the outside of the treatment liquid drying processing barrel 46, and a heating unit that heats the air. Reference signs of the air blowing unit and the heating unit are omitted for the sake of illustration.

The paper S is transferred from the treatment liquid application unit 14 to the treatment liquid drying processing unit 16, and has the leading end gripped by the grippers 46A of the treatment liquid drying processing barrel 46.

The paper S is held by the grippers 46A in a state where a surface on which the treatment liquid is coated is directed to the inside of the treatment liquid drying processing barrel 46, and a surface opposite to the surface on which the treatment liquid is coated is supported by the paper transportation guide 48. By rotating the treatment liquid drying processing barrel 46, the paper S is transported along the outer peripheral surface 46C of the treatment liquid drying processing barrel 46.

The air heated from the treatment liquid drying processing unit 50 is blown against the paper S transported by the treatment liquid drying processing barrel 46, and the drying processing is performed on the paper S.

If the drying processing is performed on the paper S, a solvent component in the treatment liquid applied to the paper S is removed, and a treatment liquid layer is formed on the surface to which the treatment liquid of the paper S is applied. The paper S on which the drying processing is performed by the treatment liquid drying processing unit 16 is transferred to the drawing unit 18.

Drawing Unit

The drawing unit 18 includes a drawing barrel 52, a paper hold-down roller 54, liquid discharge heads 56C, 56M, 56Y, and 56K, and an inline sensor 58. A gripper 52A of the drawing barrel 52 is disposed inside a recess provided in an outer peripheral surface 52C of the drawing barrel 52. The same configuration as that of the gripper 40A of the paper feed barrel 40 can be applied to configurations other than the arrangement of the gripper 52A.

Grippers 52A are disposed in two places in the treatment liquid barrel 42, similar to the drawing barrel 52. Additionally, suction holes for suctioning the paper S are disposed in a medium support region, where the paper S is supported, in the outer peripheral surface 52C of the drawing barrel 52. In addition, illustration of the suction holes and the medium support region is omitted. The same configuration as that of the treatment liquid barrel 42 can be applied to the configuration other than the above configuration regarding the drawing barrel 52. Reference sign 52B designates a rotating shaft of the drawing barrel 52.

The paper hold-down roller 54 presses the paper S toward the drawing barrel 52, and brings the paper S into close contact with to the peripheral surface of the drawing barrel 52. The paper hold-down roller 54 is disposed on a downstream side of a transfer position of the paper S and on an upstream side of the liquid discharge head 56C, in a transporting direction of the paper S in the drawing barrel 52. In the following description, the transporting direction of the paper S may be described as the paper transporting direction. The paper transporting direction is equivalent to a medium transporting direction.

The liquid discharge heads 56C, 56M, 56Y, and 56K are respectively ink jet heads that discharges a liquid through an ink jet method. Alphabets given to reference signs of the liquid discharge heads represents colors of ink. C represents cyan. M represents magenta. Y represents yellow. K represents black. Ink is supplied to the liquid discharge heads 56C, 56M, 56Y, and 56K, respectively, via pipe lines (not illustrated) from ink tanks (not illustrated) that are corresponding ink supply sources of the colors.

Each of the liquid discharge heads 56C, 56M, 56Y, and 56K is a full line type ink jet head having a drawable width of a length corresponding to a maximum width of an image formation region in the paper S. A nozzle row in which a plurality of nozzle openings serving as liquid discharge ports over the entire region of the drawable width are arrayed is formed in the nozzle surface of each of the liquid discharge heads 56C, 56M, 56Y, and 56K. The "nozzle surface" is synonymous with a "discharge surface". In addition, in present disclosure, the liquid discharge head may simply be referred to as a "head".

The liquid discharge heads 56C, 56M, 56Y, and 56K are disposed on an upper side of the drawing barrel 52 in a posture in which the nozzle surface of each head is inclined with respect to a horizontal plane such that the nozzle surface of each head have an approximately constant distance with respect to the peripheral surface of the drawing barrel 52. That is, the liquid discharge heads 56C, 56M, 56Y, and 56K are radially disposed at regular intervals in the circumferential direction on a concentric circle centered on the rotating shaft 52B of the drawing barrel 52. In the present example, four heads are bisymmetrically disposed with a vertical line (centerline) passing through a rotation center of the drawing barrel 52 interposed therebetween.

In this way, the liquid discharge heads 56C, 56M, 56Y, and 56K are disposed such that the respective nozzle surfaces thereof face the outer peripheral surface of the drawing barrel 52, and are disposed at positions where the respective nozzle surfaces have predetermined heights in a radial direction (a direction perpendicular to the outer peripheral surface) from the outer peripheral surface of the drawing barrel 52. That is, the same amount of gap is formed between the outer peripheral surface of the drawing barrel 52 and the nozzle surface of each head.

The liquid discharge heads 56C, 56M, 56Y, and 56K are disposed in order of the liquid discharge head 56C, the liquid discharge head 56M, the liquid discharge head 56Y, and the liquid discharge head 56K from the upstream side in the paper transporting direction, in the circumferential direction of the drawing barrel 52.

Although a configuration in which ink in four colors that are standard colors of CMYK is used is illustrated in the present example, the combinations of ink colors or the number of colors are not limited to the present embodiment. Any of light ink, dark ink, or special color ink, and the like may be added to the configuration in which ink in four colors of CMYK is used, if necessary. For example, a configuration to which liquid discharge heads that discharge light ink in light cyan, light magenta, and the like are added, and a configuration to which an liquid discharge head that discharges special color ink in green, orange, and the like is added may also be adopted. Additionally, the arrangement order of the liquid discharge heads for the respective colors is also not limited particularly.

Although not illustrated in FIG. 1, the four liquid discharge heads 56C, 56M, 56Y, and 56K are supported by a common head supporting frame. An entire head unit consisting of the four liquid discharge heads 56C, 56M, 56Y, and 56K attached to the head supporting frame can be moved in the radial direction of the drawing barrel 52 together with the head supporting frame. Additionally, the entire head unit of the four liquid discharge heads 56C, 56M, 56Y, and 56K can be moved in an axial direction of the drawing barrel 52 together with the head supporting frame.

Moreover, although not illustrated, each of the liquid discharge heads 56C, 56M, 56Y, and 56K is supported by a movable supporting mechanism movable in a normal direction of the nozzle surface. By this movable supporting mechanism, the distance (gap) between the nozzle surface of each head and the outer peripheral surface of the drawing barrel 52 can be adjusted, or the height of the head at a maintenance position can be changed for each head.

The inline sensor 58 is disposed on the downstream side of the liquid discharge head 56K in the paper transporting direction. The inline sensor 58 is configured to include an imaging device, a peripheral circuit of an imaging device, and a light source. Illustration of the imaging device, the peripheral circuit of the imaging device, and the light source is omitted.

Solid-state imaging devices, such as a CCD image sensor and a CMOS image sensor, can be used as the imaging device. The CCD is an abbreviation of Charge Coupled Device. The CMOS is an abbreviation of Complementary Metal-Oxide Semiconductor.

A processing circuit for an output signal of the imaging device is included in the peripheral circuit of then imaging device. The processing circuit includes a filter circuit, an amplifying circuit, a waveform shaping circuit, or the like that removes a noise component from the output signal of the imaging device. Illustration of the filter circuit, the amplifying circuit, or the waveform shaping circuit is omitted.

The light source is disposed at a position where a reading object of the inline sensor 58 is capable of being irradiated with illumination light. An LED, a lamp, or the like can be applied to the light source. The LED is an abbreviation of Light Emitting Diode.

The paper S transferred from the treatment liquid drying processing unit 16 to the drawing unit 18 has the leading end gripped by the grippers 52A of the drawing barrel 52. The paper S having the leading end gripped by the grippers 52A of the drawing barrel 52 is transported along the outer peripheral surface 52C of the drawing barrel 52 by the rotation of the drawing barrel 52.

The paper S is pressed against the outer peripheral surface 52C of the drawing barrel 52 when passing below the paper hold-down roller 54. An image is formed on the paper S that has passed below the paper hold-down roller 54, with the ink discharged from each of the liquid discharge heads 56C, 56M, 56Y, and 56K directly below the liquid discharge heads 56C, 56M, 56Y, and 56K.

An image is read by the inline sensor 58 in a reading region of the inline sensor 58, from the paper S on which the image is formed by the liquid discharge heads 56C, 56M, 56Y, and 56K.

The paper S from which the image is read by the inline sensor 58 is transferred from the drawing unit 18 to the ink drying processing unit 20. The presence/absence of a discharge abnormality may be determined from a result of the reading of the image by the inline sensor 58.

Ink Drying Processing Unit

The ink drying processing unit 20 includes a chain gripper 64, an ink drying processing unit 68, and a guide plate 72. The chain gripper 64 is configured to include a first sprocket 64A, a second sprocket 64B, a chain 64C, and a plurality of grippers 64D.

The chain gripper 64 has a structure in which a pair of endless chains 64C is wound around a pair of first sprockets 64A and the second sprocket 64B. Only one side among the pair of first sprockets 64A, the second sprocket 64B, and the pair of chains 64C is illustrated in FIG. 1.

The chain gripper 64 has a structure in which the plurality of grippers 64D is disposed between the pair of chains 64C. Additionally, the chain gripper 64 has a structure in which the plurality of grippers 64D are disposed at a plurality of positions in the paper transporting direction. Only one gripper 64D among the plurality of grippers 64D disposed between the pair of chains 64C is illustrated in FIG. 1.

A transporting path for the paper S by the chain gripper 64 illustrated in FIG. 1 includes a horizontal transportation region where the paper S is transported in a horizontal direction, and an inclined transportation region where the paper S is transported in an oblique upward direction.

The ink drying processing unit 68 is disposed on the transporting path for the paper S in the chain gripper 64. A configuration example of the ink drying processing unit 68 includes a configuration including a heat source, such as a halogen heater or an infrared heater. Another configuration example of the ink drying processing unit 68 includes a configuration including a fan that blows the air heated by the heat source to the paper S. The ink drying processing unit 68 may have a configuration including the heat source and the fan.

Although detailed illustration of the guide plate 72 is omitted, a plate-shaped member may be applied to the guide plate 72. The guide plate 72 has a length exceeding the total length of the paper S in the direction orthogonal to the paper transporting direction.

The guide plate 72 is disposed along the transporting path in the horizontal transportation region of the paper S by the chain gripper 64. The guide plate 72 is disposed on the lower side of the transporting path for the paper S by the chain gripper 64. The guide plate 72 has a length corresponding to the length of a processing region of the ink drying processing unit 68 in the paper transporting direction.

The length corresponding to the length of the processing region of the ink drying processing unit 68 is the length of the guide plate 72 by which the paper S is capable of being supported by the guide plate 72, in the case of the processing of the ink drying processing unit 68.

For example, an aspect in which the length of the processing region of the ink drying processing unit 68 and the length of the guide plate 72 are made the same in the paper transporting direction is included. The guide plate 72 may have the function of suctioning and supporting the paper S.

The paper S transferred to the ink drying processing unit 20 from the drawing unit 18 has the leading end gripped by the grippers 64D. If at least one e of the first sprockets 64A or the second sprocket 64B is rotated clockwise in FIG. 1 and is made to travel along the chain 64C, the paper S is transported along a traveling path of the chain 64C.

When the paper S passes through the processing region of the ink drying processing unit 68, ink drying processing is performed on the paper S by the ink drying processing unit 68.

The paper S on which the ink drying processing is performed by the ink drying processing unit 68 is transported by the chain gripper 64, and is sent to the paper ejection unit 24.

The chain gripper 64 illustrated in FIG. 1 transports the paper S in a leftwardly inclined upward direction in FIG. 1, on the downstream side of the ink drying processing unit 68 in the paper transporting direction. The guide plate 73 is disposed on the transporting path of the inclined transportation region where the paper S is transported in the leftwardly inclined upward direction in FIG. 1.

The same member as the guide plate 72 can be applied to the guide plate 73. The description of the structure and functions of the guide plate 73 will be omitted.

Paper Ejection Unit

The paper ejection unit 24 includes a paper ejection platform 76. The chain gripper 64 is applied to the transportation of the paper S in the paper ejection unit 24. The paper ejection platform 76 is disposed on the lower side of the transporting path for the paper S by the chain gripper 64. A configuration including a lifting mechanism (not illustrated) is possible for the paper ejection platform 76. The paper ejection platform 76 is capable of keeping the height of the paper S located at an uppermost position constant by being lifted and lowered according to an increase or decrease of the stacked paper S.

The paper ejection unit 24 recovers the paper S subjected to a series of image formation processing. If the paper S arrives at the position of the paper ejection platform 76, the gripper 64D releases the gripping of the paper S. The paper S is stacked on the paper ejection platform 76.

Although the ink jet recording device 10 including the treatment liquid application unit 14 and the treatment liquid drying processing unit 16 is illustrated in FIG. 1, a form in which the treatment liquid application unit 14 and the treatment liquid drying processing unit 16 are eliminated is also possible.

Additionally, although the chain gripper 64 is illustrated in FIG. 1 as a configuration in which the paper S after drawing is transported, other configurations, such as belt transportation and drum transportation, may be applied to the configuration in which the paper S after drawing is transported.

Although illustration is omitted in FIG. 1, the ink jet recording device 10 includes the maintenance unit. The maintenance unit is installed in parallel with the drawing barrel 52 in the axial direction of the rotating shaft 52B of the drawing barrel 52.

Description of Maintenance Unit

Figure 2:
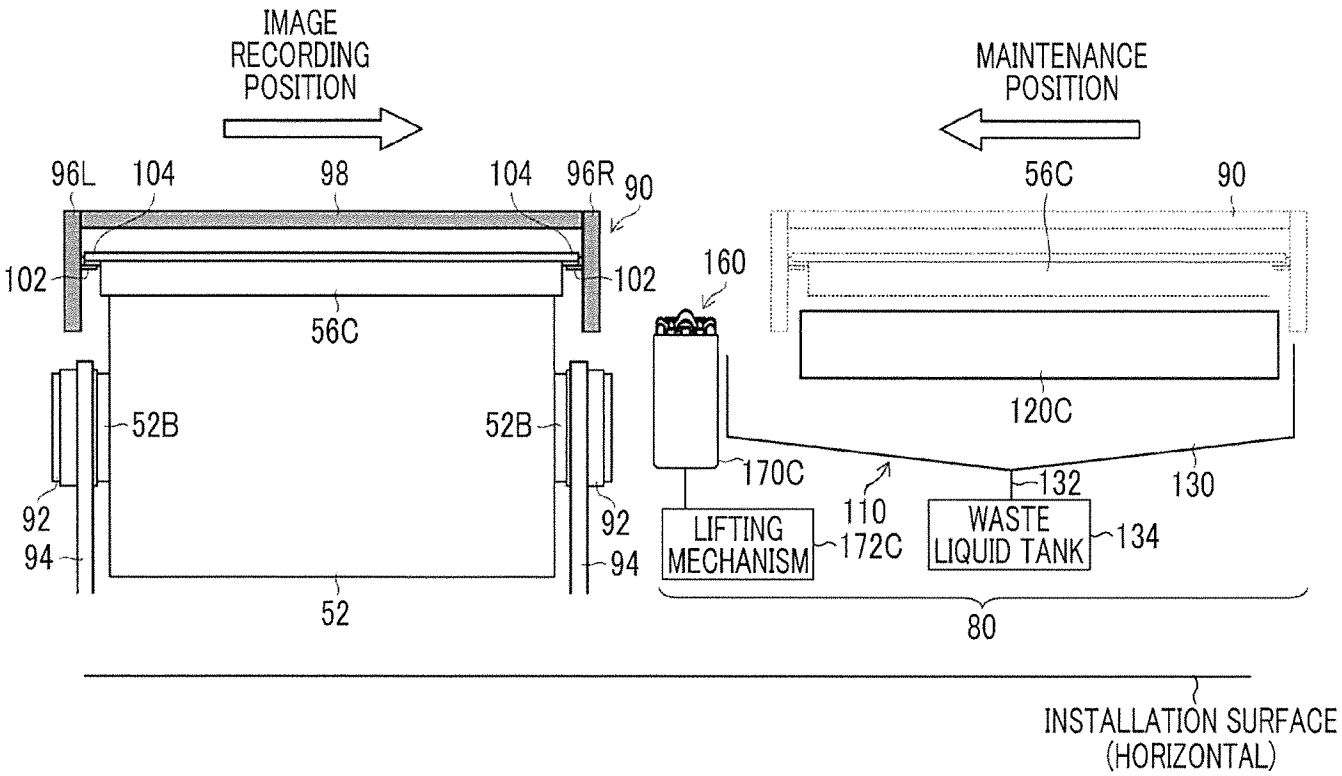
FIG. 2 is a front view schematically illustrating the configuration of a maintenance unit.
Figure 3:
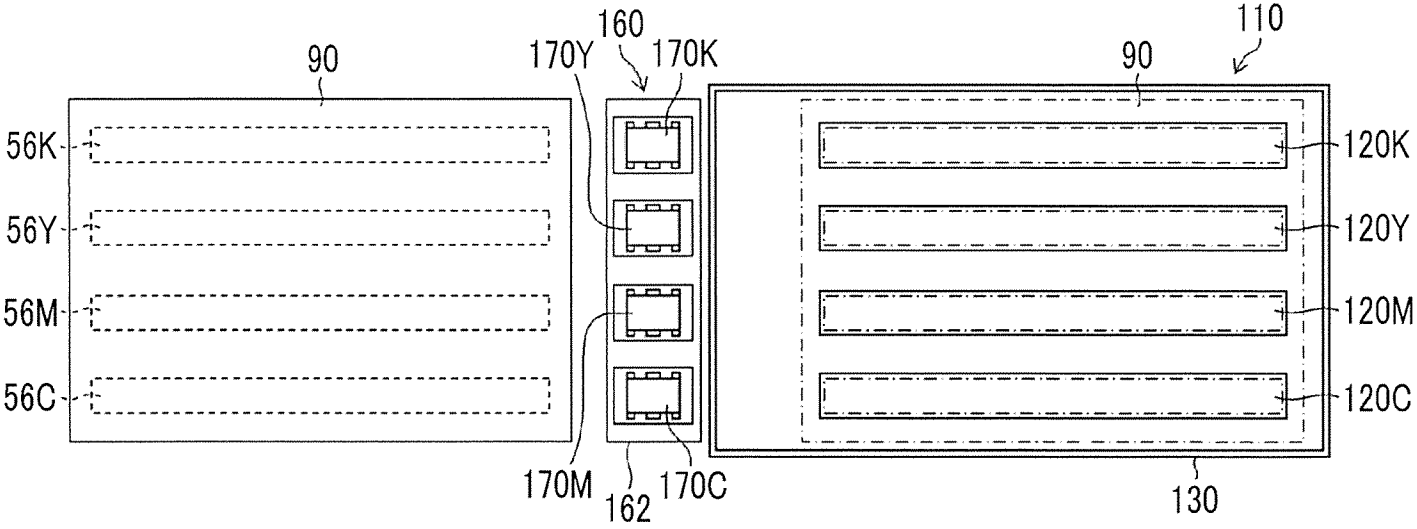
FIG. 3 is a plan developed explanatory view schematically illustrating the configuration of a drawing unit and the maintenance unit.

FIG. 2 is a front view schematically illustrating the configuration of a maintenance unit 80 juxtaposed with the drawing unit 18. FIG. 2 is a view when the drawing unit 18 is seen from the upstream side to the downstream side in the paper transporting direction. Additionally, FIG. 3 is a plan developed explanatory view schematically illustrating the configuration of the drawing unit 18 and the maintenance unit 80.

Only the liquid discharge head 56C for cyan among the four liquid discharge heads 56C, 56M, 56Y, and 56K described in FIG. 1 is illustrated in FIG. 2. As already described, the plurality of liquid discharge heads 56C, 56M, 56Y, and 56K are attached to the common head supporting frame 90.

The drawing barrel 52 has both end parts of the rotating shaft 52B pivotally supported by a pair of bearings 92, and is rotatably provided (refer to FIG. 2). The bearings 92 are provided in a body frame 94 of the ink jet recording device 10. When both the end parts of the rotating shaft 52B are pivotally supported by the bearings 92, the drawing barrel 52 has the rotating shaft 52B attached parallel to a horizontal installation surface. A motor is coupled to the rotating shaft 52B of the drawing barrel 52 via a rotation transmission mechanism. Illustration of a motor for driving of a paper transportation system and the rotation transmission mechanism is omitted. The drawing barrel 52 is driven and rotated by the motor for the driving of the paper transportation system (not illustrated).

The head supporting frame 90 is configured to include a pair of side plates 96L and 96R and a coupling frame 98. The pair of side plates 96L and 96R are disposed to intersect the rotating shaft 52B of the drawing barrel 52 at right angles. The coupling frame 98 is a member that couples the side plates 96L and 96R together at upper end parts thereof.

The side plates 96L and 96R are formed in a plate shape, and are disposed to face each other with the drawing barrel 52 interposed therebetween. Attaching parts 102 for attaching the liquid discharge heads 56C, 56M, 56Y, and 56K are provided inside the pair of side plates 96L and 96R. Although only the attaching part 102 for attaching the liquid discharge head 56C for cyan is illustrated for convenience in FIG. 3, the same attaching parts are provided regarding the heads for the respective colors.

The attaching parts 102 are disposed radially at regular intervals on a concentric circle centered on the rotating shaft 52B of the drawing barrel 52. The liquid discharge heads 56C, 56M, 56Y, and 56K are attached to the head supporting frame 90 by fixing parts 104 to be attached that are formed at both ends of each head to the attaching part 102. Although only the part 104 to be attached in the liquid discharge head 56C for cyan is illustrated for convenience in FIG. 2, the same parts to be attached are provided regarding the heads for the respective colors.

The head supporting frame 90 is guided by a guide rail (not illustrated), and is provided to be slidingly movable parallel to the axial direction of the rotating shaft 52B of the drawing barrel 52. That is, a head supporting frame moving mechanism (not illustrated) slidingly moves the head supporting frame 90 horizontally in the direction orthogonal to the paper transporting direction. The head supporting frame moving mechanism is configured to include, for example, a ceiling frame that is horizontally installed across a paper transporting mechanism, a guide rail laid on the ceiling frame, a traveling body that slidingly moves on the guide rail, and drive means for moving the traveling body along the guide rail. An example of a linear drive mechanism that can be adopted as the drive means may include a screw feed mechanism or the like. The head supporting frame 90 is attached to the traveling body, and slidingly moves horizontally along the guide rail.

By virtue of such a configuration, the liquid discharge heads 56C, 56M, 56Y, and 56K loaded onto the head supporting frame 90 are capable of moving between an "image recording position" illustrated by a solid line in FIG. 2, and the "maintenance position" illustrated by a dashed line in FIG. 2. Means for moving the head supporting frame 90 between the image recording position and the maintenance position is equivalent to one form of "relative movement means".

If the head supporting frame 90 is located at the image recording position, the liquid discharge heads 56C, 56M, 56Y, and 56K are disposed around the drawing barrel 52 and are brought into an image-recordable state.

The maintenance position is set to a position (standby position) where the liquid discharge heads 56C, 56M, 56Y, and 56K are withdrawn from the drawing barrel 52. A moisturizing unit 110 for moisturizing each of the liquid discharge heads 56C, 56M, 56Y, and 56K is installed at this maintenance position.

As illustrated in FIG. 3, the moisturizing unit 110 includes caps 120C, 120M, 120Y, and 120K that cover the respective nozzle surfaces of the liquid discharge heads 56C, 56M, 56Y, and 56K. In order to make the invention easily understood, a drawing in which a configuration of the heads for the respective colors and the caps corresponding to the respective heads, which are disposed along a circular arc of the peripheral surface of the drawing barrel 52, is developed on a plane is illustrated by FIG. 3.

In a case where the device is stopped for a long time, such as at the time of power source OFF of the device or printing standby, or during a period for waiting for the input of a printing job, that is, during a non-printing period while ink discharge for image formation is performed, the liquid discharge heads 56C, 56M, 56Y, and 56K are moved to the maintenance position, and the nozzle surfaces of the respective heads are covered with the caps 120C, 120M, 120Y, and 120K.

Each of the caps 120C, 120M, 120Y, and 120K is provided with a moisturizing liquid supply mechanism (not illustrated), which is configured such that a moisturizing liquid can be supplied to the inside of the cap. By covering peripheries of the nozzle surfaces of the respective heads with the caps 120C, 120M, 120Y, and 120K in which the moisturizing liquid is held, a nozzle part is moisturized, and clogging caused by drying is suppressed. As the moisturizing liquid, ink can be used and a solvent component of ink can also be used. The caps 120C, 120M, 120Y, and 120K can be used as ink receptacles in the case of preliminary discharge or pressurization purge. The preliminary discharge is also referred to as "dummy jet".

In addition, the caps 120C, 120M, 120Y, and 120K are provided with a pressurizing and suctioning mechanism (that are not illustrated), which is configured such that the inside of each nozzle can be pressurized and sucked. Additionally, in the case of the present example, each of the liquid discharge heads 56C, 56M, 56Y, and 56K is capable of performing the pressurization purge of forcedly pushing out ink from the nozzles of each head through the back-pressure control of pressurizing an ink supply system.

Each of the liquid discharge heads 56C, 56M, 56Y, and 56K is configured by joining a plurality of head modules together, so that the pressurization purge can be carried out on a head module basis.

A waste liquid tray 130 is disposed at a position below the caps 120C, 120M, 120Y, and 120K. The moisturizing liquid supplied to the caps 120C, 120M, 120Y, and 120K or the ink discharged from the liquid discharge heads 56C, 56M, 56Y, and 56K is disposed of to the waste liquid tray 130, and is recovered by a waste liquid tank 134 via a waste liquid recovery pipe 132.

Additionally, a nozzle surface wiping device 160 for cleaning the nozzle surfaces of the respective liquid discharge heads 56C, 56M, 56Y, and 56K is provided between the image recording position and the maintenance position. Although only a wiping unit 170C and its lifting mechanism 172C corresponding to the liquid discharge head 56C for cyan are illustrated in FIG. 2, wiping units 170C, 170M, 170Y, and 170K, as illustrated in FIG. 3, are provided with respect to the respective liquid discharge heads 56C, 56M, 56Y, and 56K.

The nozzle surface wiping device 160 is configured to include the wiping units 170C, 170M, 170Y, and 170K attached to a wiping device body frame 162, and a cleaning liquid supply mechanism that supplies the cleaning liquid to each of the wiping units 170C, 170M, 170Y, and 170K. Illustration of the cleaning liquid supply mechanism is omitted in FIG. 3. Additionally, the nozzle surface wiping device 160 may include a lifting mechanism that individually lifts and lowers each of the wiping units 170C, 170M, 170Y, and 170K with respect to the wiping device body frame 162, and a wiping device body lifting mechanism that lifts and lowers the wiping device body frame 162. In FIG. 3, illustration of the individual lifting mechanisms provided corresponding to the wiping units 170C, 170M, 170Y, and 170K, respectively, and the wiping device body lifting mechanism is omitted.

The nozzle surfaces of the respective liquid discharge heads 56C, 56M, 56Y, and 56K are wiped by the corresponding wiping units 170C, 170M, 170Y, and 170K, respectively, in the process of moving from the maintenance position to the image recording position or in the process of moving from the image recording position to the maintenance position.

Configuration Example of Nozzle Surface Wiping Device

Since the structures of the wiping units 170C, 170M, 170Y, and 170K are the same, these wiping units will be described below as the wiping unit 170. Additionally, regarding the description of items common to the liquid discharge heads 56C, 56M, 56Y, and 56K for the respective colors, a liquid discharge head will be designated by reference sign 56 on behalf of the liquid discharge heads 56C, 56M, 56Y, and 56K, and will be described.

Figure 4:
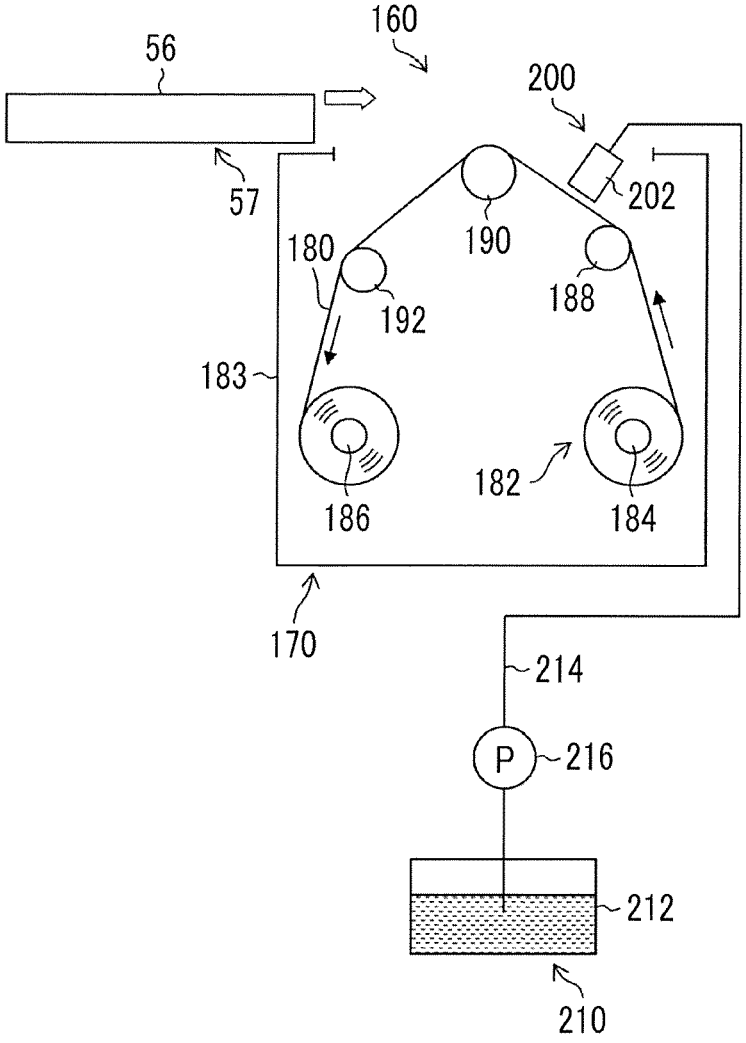
FIG. 4 is a schematic view illustrating a configuration example of a nozzle surface wiping device.

FIG. 4 is a schematic view illustrating a configuration example of the nozzle surface wiping device 160. The nozzle surface wiping device 160 includes the wiping unit 170 and a cleaning liquid application unit 200. The wiping unit 170 has a web 180, a web transporting unit 182, and a case 183 that houses these respective members and opens on an upper surface side thereof.

The web 180 is constituted by a sheet consisting of, for example, polyethylene terephthalate, polyethylene, nylon, or weavings or knittings using ultrafine fibers, such as polyamide synthetic fibers, and is formed in an elongated belt shape having a width corresponding to the width of the nozzle surface 57 of the liquid discharge head 56 in a lateral direction. The web 180 is wound in the shape of a roll around a delivery shaft 184 in a dry state. Additionally, a leading end part of the web 180 is fixed to a winding shaft 186.

The web transporting unit 182 includes the delivery shaft 184, the winding shaft 186, a first guide roller 188, a pressing roller 190, and a second guide roller 192. The delivery shaft 184 is a shaft member on a sending-out side where the web 180 before wiping is sent out. The winding shaft 186 is a shaft member on a winding side where the wiped web 180 is wound up. The delivery shaft 184 and the winding shaft 186 are rotated by a motor (not illustrated). The first guide roller 188 is a guide member that rotates while abutting against the web 180 sent out from the delivery shaft 184, and guides the web 180 toward the pressing roller 190.

The pressing roller 190 functions as pressing means for making the web 180 abut against the nozzle surface 57 of the liquid discharge head 56 with a predetermined pressure. The pressing roller 190 is urged in a direction toward the nozzle surface 57 by an urging spring (not illustrated).

Silicon, ethylenepropylenediene rubber, or polyurethane may be used as a material for a pressing portion of the pressing roller 190.

The power of a motor (not illustrated) used as a power source is transmitted to the winding shaft 186 and the delivery shaft 184 via a power transmission device (not illustrated), and the winding shaft 186 and the delivery shaft 184 are rotationally driven.

The web 180 is sent out from the delivery shaft 184, is guided by the first guide roller 188, is wound around the pressing roller 190, and is wound up around the winding shaft 186 via the second guide roller 192. The web 180 travels along a traveling path for the web 180 ranging from the delivery shaft 184 via the first guide roller 188, the pressing roller 190, and the second guide roller 192 to the winding shaft 186. The web transporting unit 182 is equivalent to one form of "web transporting means".

The pressing roller 190 is disposed within the case 183 in a posture in which a rotating shaft thereof becomes parallel to the lateral direction of the liquid discharge head 56 and parallel to the nozzle surface 57. The lateral direction of the liquid discharge head 56 is a direction that become parallel to the paper transporting direction.

The traveling direction of the web 180 is a direction opposite to a movement direction of the liquid discharge head 56 at a contacting part position with the nozzle surface 57. That is, the web 180 is transported in a direction opposite to a relative movement direction of the liquid discharge head 56 relative to the wiping unit 170.

The cleaning liquid application unit 200 includes a cleaning liquid supply nozzle 202. The cleaning liquid supply nozzle 202 is installed closer to an upstream side in a web traveling direction than the pressing roller 190. A cleaning liquid supply unit 210 for supplying the cleaning liquid to the cleaning liquid supply nozzle 202 is configured to include a cleaning liquid tank 212 in which the cleaning liquid is stored, a cleaning liquid flow passage 214, and a cleaning liquid pump 216. The cleaning liquid flow passage 214 is a flow passage that connects the cleaning liquid tank 212 and the cleaning liquid supply nozzle 202 together. The cleaning liquid pump 216 is provided in the cleaning liquid flow passage 214, and sends the cleaning liquid from the cleaning liquid tank 212 to the cleaning liquid supply nozzle 202. By driving the cleaning liquid pump 216, the cleaning liquid is supplied to the cleaning liquid supply nozzle 202 through the cleaning liquid flow passage 214. A tube pump can be used as the cleaning liquid pump 216.

The cleaning liquid supply nozzle 202 has a spray nozzle having a width corresponding to the width of the web 180, and sprays the cleaning liquid from the spray nozzle. The cleaning liquid supply nozzle 202 is installed so as to add the cleaning liquid downward and dropwise. When the web 180 passes below the cleaning liquid supply nozzle 202, the cleaning liquid added dropwise from the cleaning liquid supply nozzle 202 is applied. Accordingly, the cleaning liquid is applied to the web 180 before wiping, and the cleaning liquid is absorbed into the web 180.

The cleaning liquid application unit 200 and the cleaning liquid supply unit 210 are examples of the cleaning liquid supply mechanism. The cleaning liquid application unit 200 is equivalent to one form of "cleaning liquid application means".

The web 180 wound around the pressing roller 190 is transported by the driving of a winding motor (not illustrated). The nozzle surface 57 can always be wiped by wiping away the nozzle surface 57 of the liquid discharge head 56 using a new surface (unused region) of the web 180 while the web 180 is made to travel. By moving the liquid discharge head 56 in a direction opposite to the traveling direction of the web 180, the nozzle surface 57 can be wiped efficiently.

As already described, the wiping unit 170 can be moved in an upward-downward direction by the lifting mechanism (not illustrated). In a case where wiping of the nozzle surface 57 is unnecessary, the wiping unit 170 can be withdrawn to a position where the web 180 does not contact the nozzle surface 57.

In addition, the wiping unit 170 is detachably mounted on the wiping device body frame 162 (refer to FIG. 3). In a case where the web 180 within the case 183 is used up, the whole case 183 can be replaced with a new wiping unit 170. The wiping unit 170 may be referred to as a term, such as a wiping web cassette, a web feed cassette, or a maintenance cassette. The ink jet recording device 10 is provided with a plurality of types of wiping units, in which the materials or the like of the web 180 are different from each other, as replaceable wiping units 170.

Verification of Problems and Causes

Figure 5:
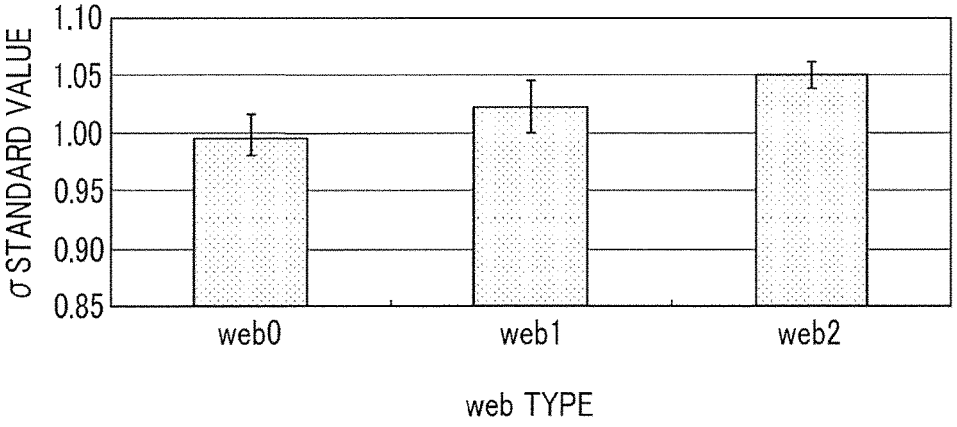
FIG. 5 is a summarized graph of results obtained by investigating changes in the variations of landing positions in a head module before and after head cleaning in a case where the type of webs is changed and the head cleaning is carried out on the same conditions.

FIG. 5 is a summarized graph of results obtained by investigating changes in the variations of landing positions in a head module before and after head cleaning in a case where the type of webs is changed and the head cleaning is carried out on the same conditions. Here, results in a case where the wiping of the nozzle surface is carried out regarding three types of webs in a state where the same amount of cleaning liquid is applied to each web are illustrated.

web0 is a web that is standardly used in the ink jet recording device 10. web0 is referred to as a standard web.

web1 is one of combined webs that are assumed to be used alternatively instead of the standard web. web1 is referred to as a first alternative web.

web2 is one of combined webs that are assumed to be used alternatively instead of the standard web. web2 is referred to as a second alternative web.

The standard deviation of a landing position error of each nozzle is represented by sigma "σ", and the amounts of change of a σ value before and after head cleaning is shown as a σ standard value. The σ standard value is a relative value obtained by being standardized on the basis of the σ value of the web0.

A bar graph of FIG. 5 illustrates average values of σ standard values together with error bars regarding the respective webs. Each of the error bars shows the range of a minimum value and a maximum value of results of a plurality of times of measurement.

Figure 6:
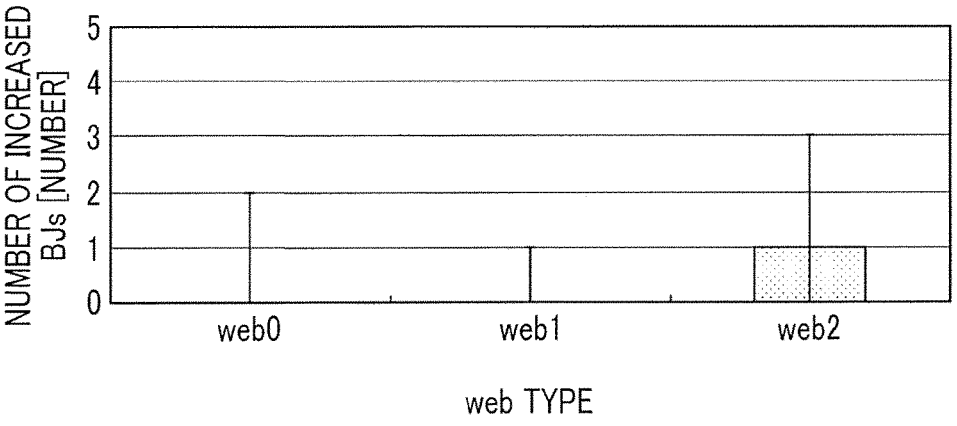
FIG. 6 is a summarized graph of results obtained by investigating the number of increased bad discharge nozzles before and after the head cleaning in a case where the type of webs is changed and the head cleaning is carried out on the same conditions.

FIG. 6 is a summarized graph of results obtained by investigating the number of increased bad discharge nozzles before and after the head cleaning in a case where the type of webs is changed and the head cleaning is carried out on the same conditions. Results in a case where the wiping of the nozzle surface is carried out regarding the three types of webs of web0, web1, and web 2 in a state where the same amount of cleaning liquid is applied to each web is illustrated in FIG. 6. The bad discharge nozzles herein are large bending nozzles in which the amount of discharge bending is large beyond an allowable prescribed range. The amount of discharge bending is synonymous with the deviation amount of a landing position. That is, the large bending nozzles are bad discharge nozzles in which the deviation amount of a landing position becomes large beyond a prescribed allowable range. Bad discharge in which discharge bending is large in this way is referred to as a bad jet, and is written as "BJ".

A bar graph of FIG. 6 illustrates average values of the numbers of increased bad jets together with error bars regarding the respective webs. In web0 and web1, since the average values of the numbers of increased large bending nozzles are 0, only error bars are illustrated. If web2 is used, it is understood that large bending nozzles increase.

As illustrated in FIGS. 5 and 6, if web1 and web2 carry out the head cleaning on the same cleaning conditions as the standard web, the variations of landing positions or large bending nozzles increase and a discharge state deteriorates.

For that reason, in order to use web1 or web2 with the same performance as web0, it is necessary to specify causes of discharge deterioration and to set suitable cleaning conditions.

Regarding the causes of the discharge deterioration as illustrated in FIGS. 5 and 6, mechanisms of hypothetical causes mentioned in FIG. 7 are considered, and potential candidates are verified.

FIG. 7 is a summarized chart of the outline of hypotheses and mechanisms regarding the causes of the discharge deterioration by the head cleaning. Here, four hypothetical causes, a foreign matter pushing theory, a bubble entrainment theory, an ink drawing-out theory, and a meniscus collapse theory, are studied.

Figure 8:
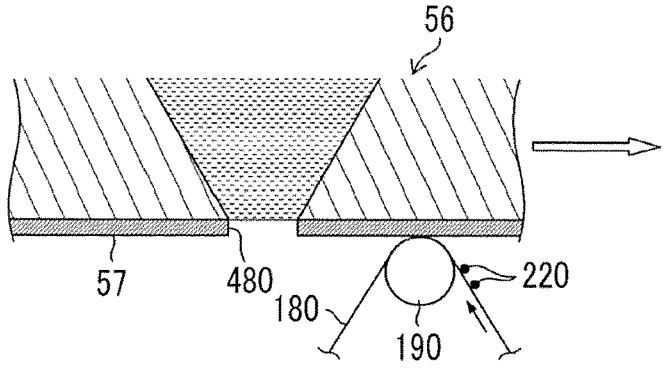
FIG. 8 is a view schematically illustrating a generation mechanism of discharge deterioration by a foreign matter pushing theory.
Figure 9:
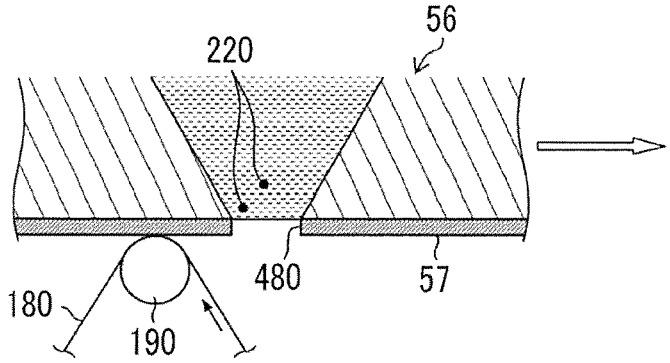
FIG. 9 is a view schematically illustrating the generation mechanism of the discharge deterioration by the foreign matter pushing theory.

FIGS. 8 and 9 are views schematically illustrating a generation mechanism of discharge deterioration by the foreign matter pushing theory. FIGS. 8 and 9 are enlarged views schematically illustrating the vicinity of a nozzle, and illustrate a state where the web 180 is abutting against the nozzle surface 57. The liquid discharge head 56 moves toward the right of FIG. 8. A feed direction of the web 180 is the direction opposite to the movement direction of the liquid discharge head 56. When the liquid discharge head 56 moves rightward in FIG. 8 from a state illustrated in FIG. 8, the liquid discharge head is brought into a state illustrated in FIG. 9.

The wiping of the nozzle surface 57 is performed by moving the liquid discharge head 56 while feeding the web 180 in the feed direction. According to the foreign matter pushing theory, it is understood that bad jets are generated by foreign matter 220 being pushed into a nozzle 480 when the foreign matter 220 adhering to the surface of the web 180 is wiped out. The bad jets being increased are abbreviated as "BJ deterioration".

In a case where the occurrence principle of the discharge deterioration by the foreign matter pushing theory is right, it is considered that splash occurs at the time of discharge due to the foreign matter 220 that has entered the nozzle 480.

However, according to verification of experiment, a remarkable phenomenon in which the occurrence of splash increases is not confirmed. Additionally, in the foreign matter pushing theory, the deterioration of σ values illustrated in FIG. 6 cannot be explained sufficiently.

Figure 10:
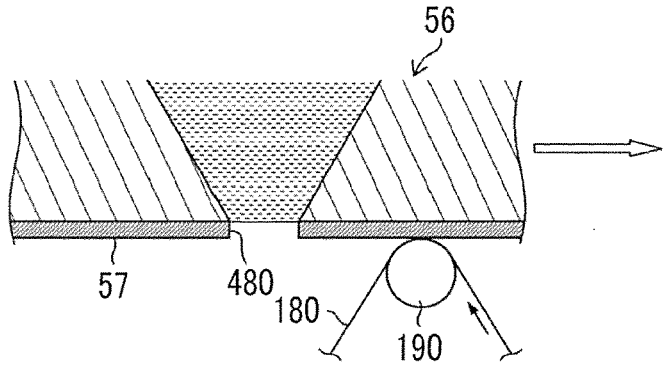
FIG. 10 is a view schematically illustrating a generation mechanism of discharge deterioration by a bubble entrainment theory.
Figure 11:
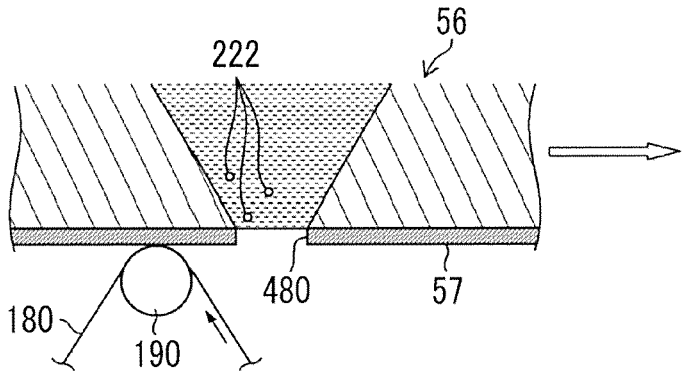
FIG. 11 is a view schematically illustrating the generation mechanism of the discharge deterioration by the bubble entrainment theory.

FIGS. 10 and 11 are view schematically illustrating a generation mechanism of discharge deterioration by the bubble entrainment theory. FIGS. 10 and 11 are enlarged views schematically illustrating the vicinity of the nozzle. The liquid discharge head 56 moves toward the right of FIG. 10. The wiping of the nozzle surface 57 is performed by moving the liquid discharge head 56 while feeding the web 180 in the feed direction.

According to the bubble entrainment theory, it is understood that bad jets are generated by air bubbles 222 being entrained into the nozzle 480 during wiping. In a case where the bubble entrainment theory is the cause of the discharge deterioration, it is considered that non-discharge occurs due to the air bubbles 222 that has entered into the nozzle 480. However, according to verification of experiment, a remarkable phenomenon in which non-discharge nozzles increase is not confirmed. Additionally, in the bubble entrainment theory, the deterioration of the a values illustrated in FIG. 6 cannot be explained sufficiently.

According to FIGS. 6 and 7, in web1 and web2, σ deterioration in which the variations of landing positions deteriorate is more remarkable than the BJ deterioration in which large bending nozzles increases. Hence, it is considered that σ deterioration caused by a change in the type of webs to be used is an item to be improved most, and the ink drawing-out theory and the meniscus collapse theory are further verified.

Figure 12:
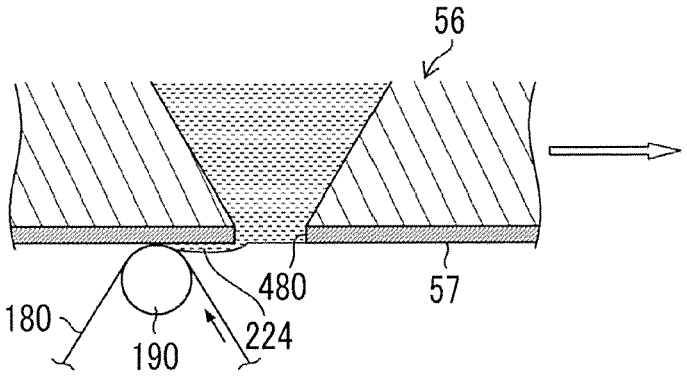
FIG. 12 is a view schematically illustrating a generation mechanism of discharge deterioration by an ink drawing-out theory.

FIG. 12 is a view schematically illustrating a generation mechanism of discharge deterioration by the ink drawing-out theory. A state before the web 180 passes through the position of the nozzle 480 is the same as that of FIG. 10.

According to the ink drawing-out theory, since the ink within the nozzle 480 is drawn out to a downstream side in a wiping direction by wiping as illustrated in FIG. 12, the ink discharged from the nozzle 480 can be drawn near to the drawn-out ink 224, and the discharge direction of the ink bends. For that reason, the landing position deviates to the downstream side in the wiping direction, and the σ deterioration occurs.

Figure 13:
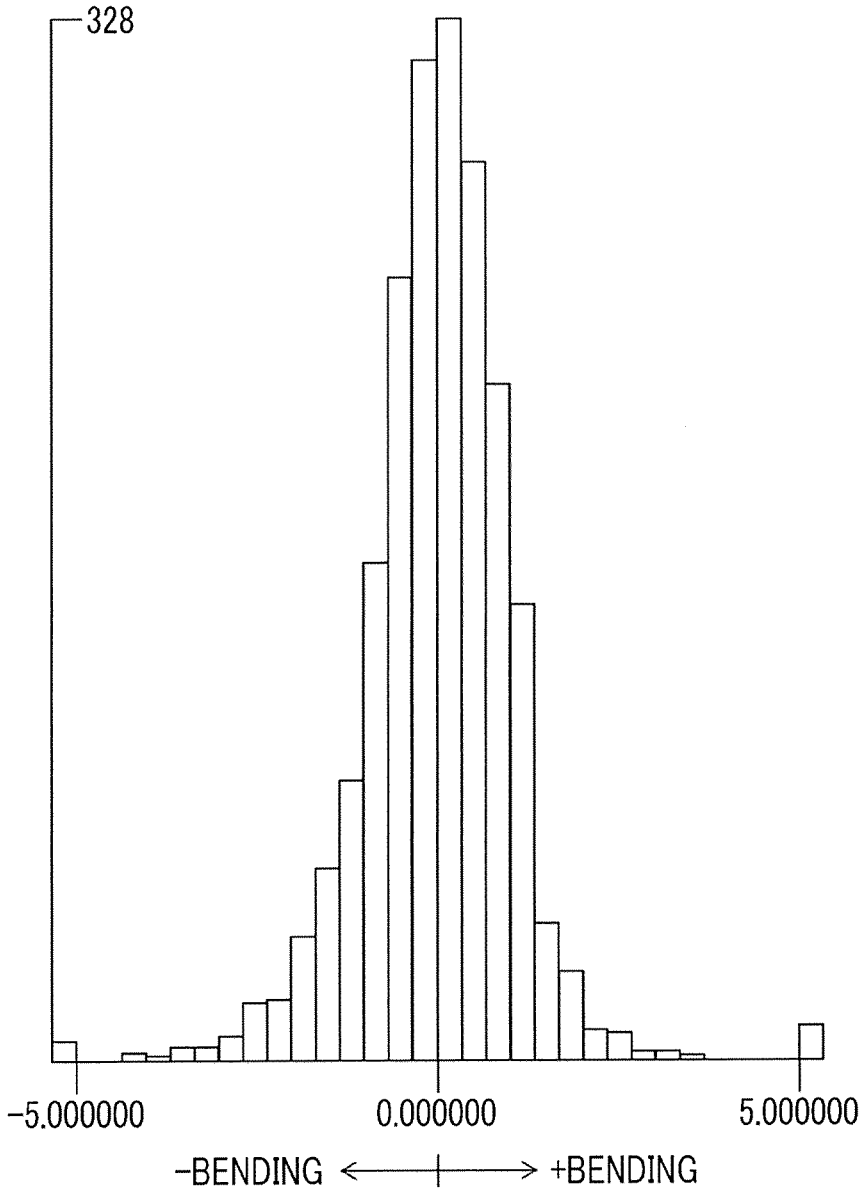
FIG. 13 is a histogram illustrating results obtained by analyzing deviation of landing positions of the respective nozzles in a head module immediately after the head cleaning.

However, if the landing position of each nozzle immediately after the head cleaning is analyzed actually, the feature that the landing position is biased and deviates in a direction toward the downstream side in the wiping direction is not observed (refer to FIG. 13).

FIG. 13 is a histogram illustrating results obtained by analyzing deviation of landing positions of the respective nozzles in a head modules immediately after the head cleaning. A horizontal axis represents the bending amount of discharge bending, and a vertical axis represents the number of nozzles. The liquid discharge head 56 is a line head configured by connecting a plurality of head modules together. The graph of FIG. 13 is results obtained by analyzing deviation of landing positions regarding one head module.

The bending amount is the deviation amount of an actual landing position with respect to a reference landing position that is an ideal design landing position. Here, the deviation amount of the landing position in an X direction parallel to the wiping direction is expressed in units of micrometers [μm]. The wiping direction is a direction in which the wiping of the nozzle surface 57 advances while the web 180 moves relative to the nozzle surface 57 of the liquid discharge head 56. In the case of the present example, the direction in which the liquid discharge head 56 moves is defined as a plus direction of an X-axis, and the wiping direction is defined as a minus direction of the X-axis. That is, the web 180 wipes the nozzle surface 57 by moving the liquid discharge head 56 in a "+X direction" while moving in a −X direction relative to the nozzle surface 57.

An origin illustrated as "0.000000" on the horizontal axis of FIG. 13 represents the ideal design landing position. As for the discharge bending, discharge bending in the plus direction with respect the reference landing position and discharge bending in the minus direction may be adopted. According to FIG. 13, there is almost no bias in the plus direction and the minus direction, and landing position errors are distributed. That is, as the discharge bending, bending in the plus direction and bending in the minus direction occur to almost the same degree, and a phenomenon in which the landing position is biased and deviates in the minus direction is not observed. Hence, it is inferred that the drawing-out of the ink according to the ink drawing-out theory is not the cause of the n deterioration. The analysis results of FIG. 13 may be a ground for denying the ink drawing-out theory.

Figure 14:
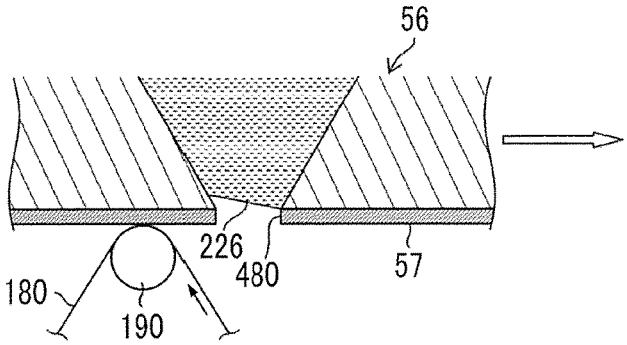
FIG. 14 is a view schematically illustrating a generation mechanism of discharge deterioration by a meniscus collapse theory.

FIG. 14 is a view schematically illustrating a generation mechanism of discharge deterioration by the meniscus collapse theory. A state before the web 180 passes through the position of the nozzle 480 is the same as that of FIG. 10. According to the meniscus collapse theory, since the ink within the nozzle 480 is sucked out by the web 180 by the head cleaning as illustrated in FIG. 14, a meniscus 226 collapses irregularly. For that reason, the ink discharged from the nozzle 480 bends in various directions, and the σ deterioration occurs. The meniscus collapse theory coincides with an actual phenomenon illustrated in FIG. 13.

It is considered that the cause that the collapse of the meniscus 226 occurs due to wiping using the web 180 is a cause that the absorbed liquid amount of the web 180 changes depending on the types of the web 180.

The absorbed liquid amounts per unit area of the respective webs were investigated for the respective types of web0, web1, and web2.

Measurement Conditions of Absorbed Liquid Amount of Web

The measurement conditions of the absorbed liquid amounts of the webs are as follows.

TABLE 1

| web Type | Area of Web | N Number | Liquid Type | Immersion Time | Standby Time After Pull-Up |
|---|---|---|---|---|---|
| web0<br>web1<br>web2 | 45 mm × 40 mm | 3 | Cleaning liquid | 30 Seconds | 10 Seconds |

Webs with a given area were immersed for a given time in the cleaning liquid, the webs were pulled up out of the cleaning liquid after the immersion, a given standby time for which the liquid was dripped was passed, and then, a mass change before and after the immersion was measured.

Web type in Table 1 refers to the types of the webs used for measurement. Area of web refers to the area of the webs that are test pieces. N number is the number of measured test pieces (samples), that is, is the number of times of measurement. Liquid type is the types of liquids applied to the test pieces of the webs. Immersion time is time for which the webs are immersed in the cleaning liquid. Standby time after pull-up is a standby time for waiting for the webs to be pulled out of the cleaning liquid after the immersion and for the liquid to be dripped from the webs. The mass change before and after the immersion may be measured as the decrease amount of the cleaning liquid, or may be measured as the increase amount of the mass of the webs by liquid absorption. Measurement environment is the temperature of 21.3° C., the relative humidity of 53%, and standard atmospheric pressure (101.325 kPa).

In addition, it is considered that the same measurement results are obtained if the measurement environment is an environment of normal temperature, normal humidity and normal atmospheric pressure. The normal temperature is a temperature range of 5° C. to 35° C. The normal humidity is a relative humidity range of 45% to 85%. The normal atmospheric pressure is a range of, for example, 86 kPa to 106 kPa.

By carrying out above-described measurement according to the measurement conditions illustrated in Table 1, absorbed liquid amounts with which the respective webs are saturated can be specified. The absorbed liquid amounts with which the webs are saturated are referred to as saturated absorbed liquid amounts.

Figure 15:
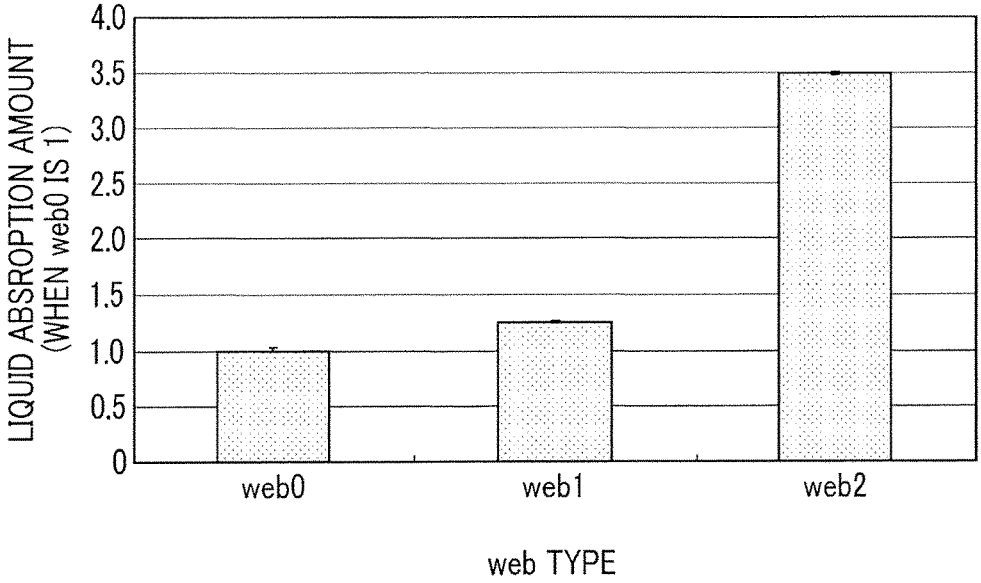
FIG. 15 is a graph illustrating measurement results of the absorbed liquid amounts of the respective webs.

FIG. 15 is a graph illustrating measurement results of the absorbed liquid amounts of the respective webs. A horizontal axis represents differences in the types of the webs, and a vertical axis represents relative absorbed liquid amounts when the absorbed liquid amount of web0 is set as "1".

As illustrated in FIG. 15, as compared to the absorbed liquid amount of web0, it was found out that web1 is an absorbed liquid amount of 1.25 times, and web2 is an absorbed liquid amount of 3.5 times. In addition, the saturated liquid amount of web0 was 180 mass % of the weight of web0 itself, the saturated liquid amount of web1 was 245 mass % of the weight of web0 itself, and the saturated liquid amount of web2 was 425 mass % of the weight of web2 itself.

Hence, in order to use each of web1 and web2 without the σ deterioration, the amount of the cleaning liquid applied to each of web1 and web2 was increased, it was estimated that it was required to soak each web in a saturated state with the cleaning liquid, and this estimation was verified.

Figures 16, 17:
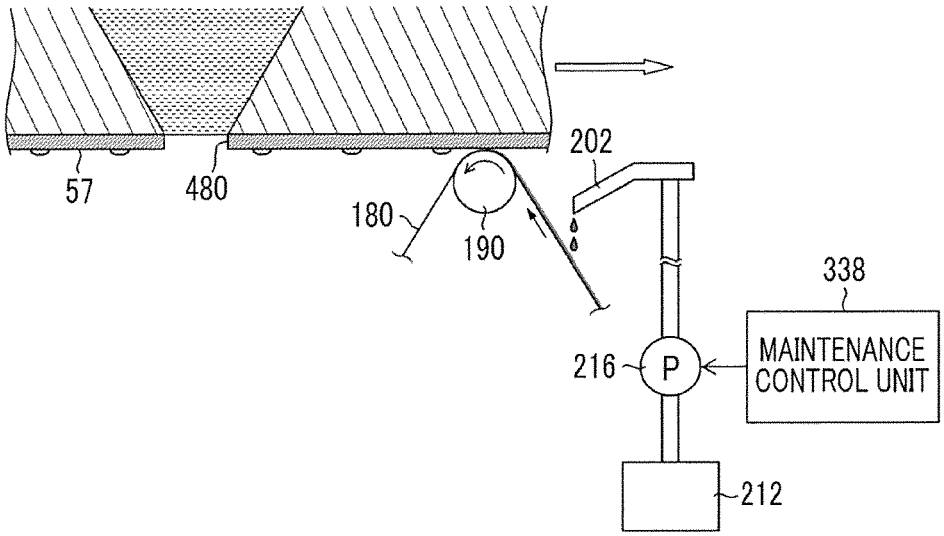
FIG. 16 is a schematic view illustrating an example of an application method of a cleaning liquid to a web.
FIG. 17 is a chart illustrating an example of cleaning liquid application conditions for applying respective saturated liquid amounts of the cleaning liquid to a plurality of types of webs.

FIG. 16 is a schematic view illustrating an example of an application method of the cleaning liquid to the web. As the application method of the cleaning liquid, as illustrated in FIG. 16, configurations in which the cleaning liquid is applied to the web 180 by adding the cleaning liquid dropwise from the cleaning liquid supply nozzle 202 can be adopted. The dropping amount of the cleaning liquid from the cleaning liquid supply nozzle 202 can be adjusted by controlling the driving of the tube pump that is the cleaning liquid pump 216. The tube pump is capable of changing liquid feed amount through voltage control. The dropping amount of the cleaning liquid from the cleaning liquid supply nozzle 202 can be increased by raising the value of a voltage that operates the tube pump. By controlling the driving of the cleaning liquid pump 216 and the feed speed of the web 180 with a maintenance control unit 338, the application amount of the cleaning liquid to the web 180 can be controlled.

The conditions for sufficiently wetting the web to brining the web into the saturated state become the conditions of satisfying the following Expression 1 if web feed speed is defined as v millimeters per second [mm/s], web feed time is defined as t seconds [s], web width is defined as w millimeters [mm], the saturated absorbed liquid amount of the web is defined as C milliliters per square millimeters [ml/mm$^2$], and liquid dropping amount is defined as L milliliters [ml].

$$L \geq v \times t \times w \times C \quad \text{[Expression 1]}$$

An example of recommendation conditions when using the respective webs from the measurement results illustrated in FIG. 15 is as being illustrated in FIG. 17.

FIG. 17 is a chart illustrating an example of cleaning liquid application conditions for applying respective saturated liquid amounts of the cleaning liquid to a plurality of types of webs. The feed speed of the webs and the liquid dropping speed of the cleaning liquid may be included in information on the cleaning liquid application conditions as illustrated in FIG. 17. The liquid dropping speed is the dropping amount of the cleaning liquid per unit time, and is equivalent to the liquid supply amount, per unit time, of the cleaning liquid to be supplied to the webs.

In the actual ink jet recording device 10, as illustrated in FIG. 17, the cleaning liquid application conditions as operating conditions when using the respective webs are determined in advance for the plurality of types of webs, and data in which the cleaning liquid application conditions corresponding to the plurality of types of webs are determined are retained in storage means within the device.

If the type of a web that a user wants to use is selected, conditions associated with the type of the web are applied, transportation of the web and dropping of the cleaning liquid are controlled such that the amount of the cleaning liquid applied to the web becomes a saturated liquid amount, and the cleaning liquid is applied while the web is fed.

In addition, in a case where the feed speed of a web is changed from a certain restriction, a suitable liquid dropping speed can be determined from the information on the conditions illustrated in FIG. 17, and the condition of [Expression 1].

Verification of the validity of the recommendation conditions illustrated in FIG. 17 was performed by carrying out the wiping of the nozzle surface in a state where saturated liquid amounts of the cleaning liquid was applied to the respective webs. Results of the verification are illustrated in FIGS. 18 and 19.

Figure 18:
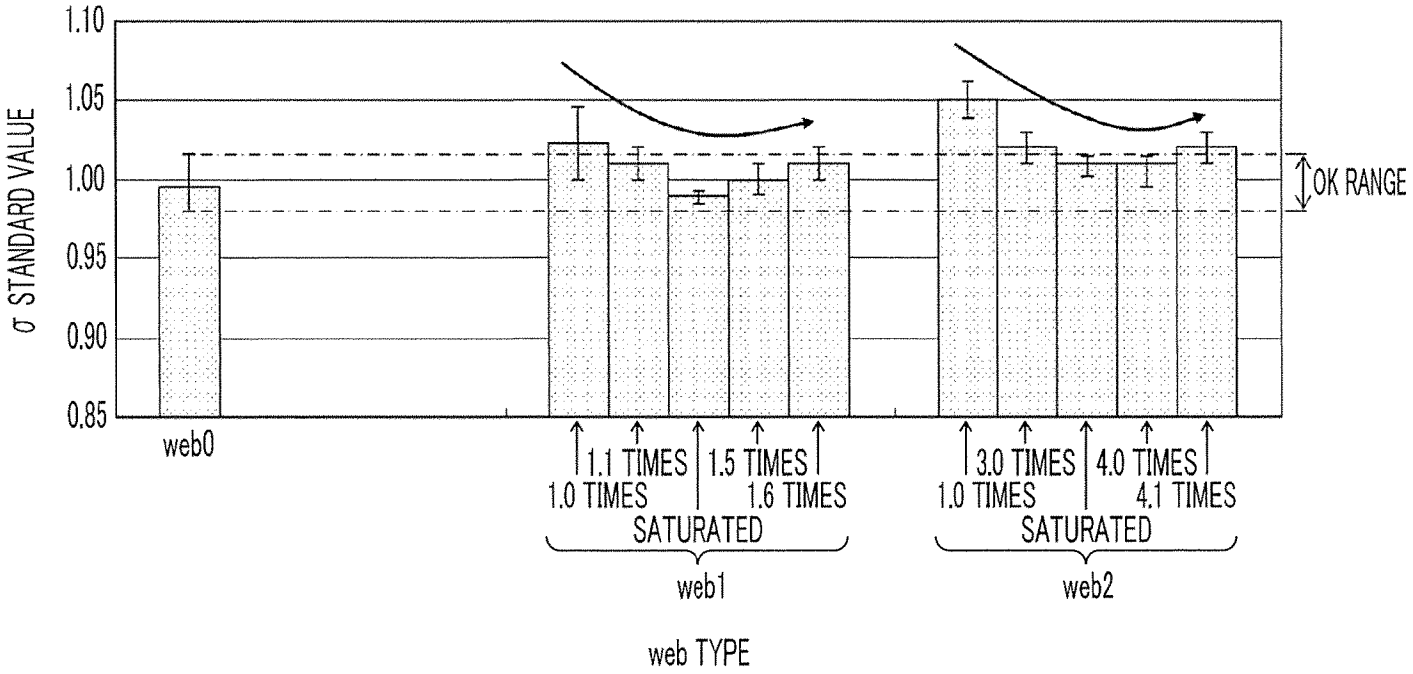
FIG. 18 is a graph illustrating changes in the variations of landing positions in a case where the application amount of the cleaning liquid is changed and wiping is carried out.

FIG. 18 is a graph illustrating changes in the variations of landing positions in a case where the application amount of the cleaning liquid is changed and wiping is carried out. The amounts of change of σ values before and after wiping in a case where the cleaning liquid is applied with respective liquid amounts of 1.0 times, 1.1 times, 1.25 times (saturated), 1.5 times, and 1.6 times of the standard application amount regarding web1 are illustrated by σ standard values in FIG. 18. The standard application amount refers to the application amount of the cleaning liquid to be applied to web0 when web0 is used. The standard application amount is equivalent to the liquid amount by which web0 is wetted in the saturated state. Additionally, the amounts of change of σ values before and after wiping in a case where the cleaning liquid is applied with respective liquid amounts of 1.0 times, 3.0 times, 3.5 times (saturation), 4.0 times, and 4.1 times of the standard application amount are illustrated by σ standard values regarding web2 in FIG. 18.

It is supposed that wiping performance equal to web0 that is the standard web is a target allowable range. The allowable range is illustrated as an "OK range".

Figure 19:
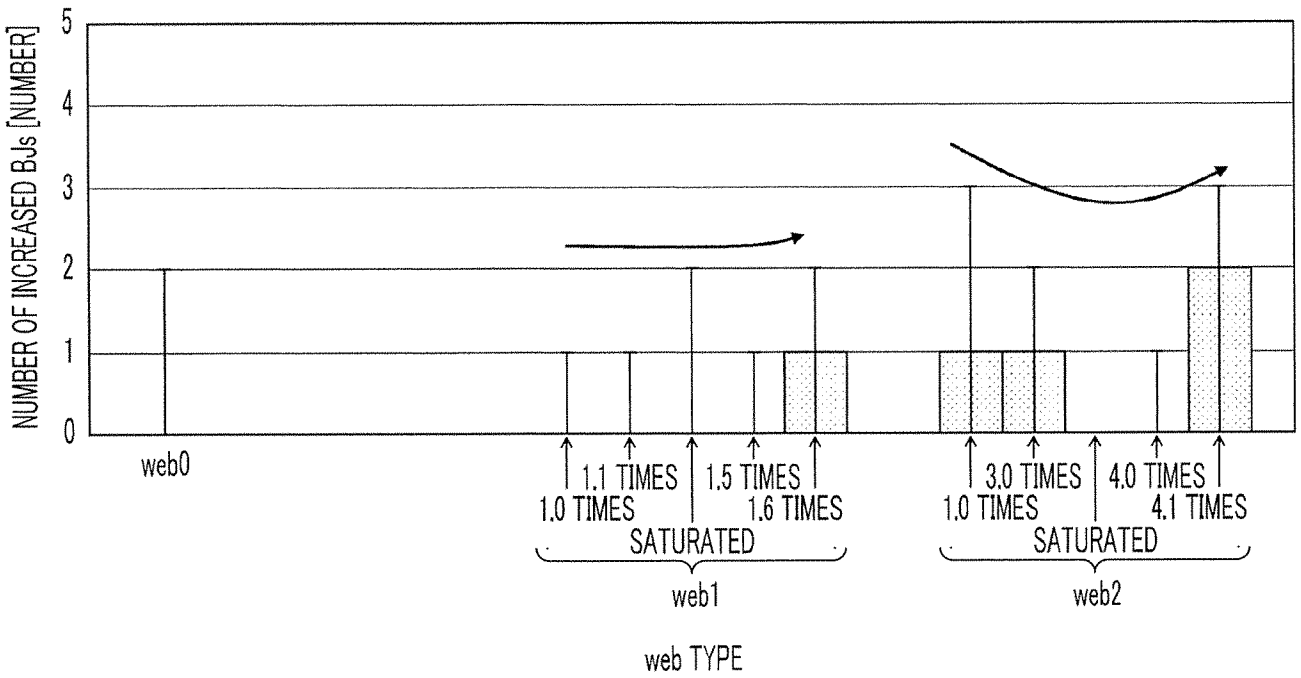
FIG. 19 is a graph illustrating the numbers of occurrence of large bending nozzles in a case where the application amount of the cleaning liquid is changed and the wiping is carried out.

FIG. 19 is a graph illustrating the numbers of occurrence of large bending nozzles in a case where the application amount of the cleaning liquid is changed and the wiping is carried out. The numbers of increased BJs before and after wiping in a case where the cleaning liquid is applied with respective liquid amounts of 1.0 times, 1.1 times, 1.25 times (saturated), 1.5 times, and 1.6 times of the standard application amount regarding web1 are illustrated in FIG. 19. Additionally, the numbers of increased BJs before and after wiping in a case where the cleaning liquid with respective liquid amounts of 1.0 times, 3.0 times, 3.5 times (saturation), 4.0 times, and 4.1 times of the standard application amount are illustrated regarding web2 in FIG. 19.

As illustrated in FIGS. 18 and 19, the σ deterioration could be improved up to the same degree as that of web0 by applying saturated liquid amounts the cleaning liquid to web1 and web2, respectively. Additionally, also regarding occurrence of large bending nozzles, it was confirmed that the BJ deterioration does not occur by applying the saturated liquid amounts of the cleaning liquid to web1 and web2, respectively.

Meanwhile, the conditions of the application amount of the cleaning liquid that is less than the saturated liquid amount regarding each of web1 and web2 were also evaluated. As a result, the discharge state is improved by increasing the amount of cleaning liquid more than the standard application amount is illustrated in FIG. 18. Although some improvements were seen as compared to a case where the cleaning liquid with the standard application amount is applied, it was found out that the application amount of the cleaning liquid is less than the level of the same allowable range as that of the standard maintenance operation by web0. Additionally, it was confirmed that deterioration does not occur also regarding bad jets as illustrated in FIG. 19.

That is, regarding both web1 and web2, the discharge state is improved as the application amount of the cleaning liquid increases from 1.0 times of the standard application amount, and an excellent discharge state that falls within the same allowable range as that of web0 in the application amount that becomes the saturated liquid amount is realized.

Moreover, each of web1 and web2 was evaluated even in a case where the cleaning liquid is excessively applied more than a saturated absorbed liquid amount. As illustrated in FIGS. 18 and 19, if the application amount of the cleaning liquid is further increased from the saturated absorbed liquid amount, the excellent discharge state that falls within the allowable range up to a certain upper limit value can be realized. However, if the upper limit value is exceeded, the discharge state tends to deteriorate. According to FIGS. 18 and 19, the upper limit value of the amount of the cleaning liquid applied to web1 is 1.5 times as large as the standard application amount. Additionally, the upper limit value of the amount of the cleaning liquid applied to web2 is 4.0 times as large as the standard application amount.

Next, regarding web1, evaluation was performed from a viewpoint of stripes in a printed material after the head cleaning. FIG. 20 is a chart illustrating evaluation results. In evaluation experiment, the operation of printing 30 sheets of sample images after the head cleaning is carried out was repeated 4 times, and the number of generated single stripes on a total of 120 sheets of a printed material was counted. The one-shot stripes means striped defects that are generated due to bad discharge of nozzles and extend in the paper transporting direction. As illustrated in FIG. 20, the number of stripes was zero in a case where the cleaning liquid with the standard application amount was applied to web0 that is the standard web and the head cleaning was carried out. The number of stripes was two in a case where the cleaning liquid with the standard application amount was applied to web1 and the head cleaning was carried out. The number of stripes was zero in a case where a saturated liquid amount of the cleaning liquid was applied to web1 and the head cleaning was carried out. As these results show, it was proved that there is an effect by setting the amount of the cleaning liquid to the saturated liquid amount.

From the knowledge based on the above-described verification, the amount of the cleaning liquid to be applied to a web needs to be equal to or more than the saturated absorbed liquid amount of the web. Additionally, if an excessive amount of the cleaning liquid markedly exceeding the saturated absorbed liquid amount is applied to the web (for example, if the conditions of the amount of the cleaning liquid to web2 are applied when web1 is used), a cleaning liquid residue more than needed may be generated in the nozzle surface, and the cleaning liquid may be dripped to soil a printing paper surface during printing. Hence, it is required to apply conditions for applying a suitable amount of the cleaning liquid to each web. The upper limit value of the amount of the cleaning liquid can be experimentally determined from a viewpoint of the allowable range as described in FIGS. 18 and 19.

The saturated absorbed liquid amount of a web defined according to the types of the webs on the basis of the measurement conditions described in Table 1 can be determined as the saturated liquid amount of each web. Otherwise, the upper limit value described in FIGS. 18 and 19 may be determined, and a liquid amount within a range equal to or more than the saturated absorbed liquid amount defined according to the type a web on the basis of the measurement conditions described in Table 1 and equal to or less than the upper limit value may be determined as a saturated liquid amount. The saturated liquid amount as the amount of the cleaning liquid to be applied to a web to be used means a liquid amount that falls within a range equal to or more than a saturated absorbed liquid amount and equal to or less than an allowed upper limit value.

Study 1 Regarding Structure of Wiping Unit

If the cleaning liquid equal to or more than a saturated absorbed liquid amount is applied to a web 180, there is concern that the following problems occur. That is, if the cleaning liquid equal to more than the saturated absorbed liquid amount is applied to the web 180, the web 180 is in a state where the cleaning liquid is absorbed and wetted to the maximum. Therefore, when the web 180 is transported, the web 180 cannot be transported well such that the web 180 sticks to a component within the case 183 or the web 180 slips and idles. As a result, there is a possibility that a winding problem may occur.

Figure 21:
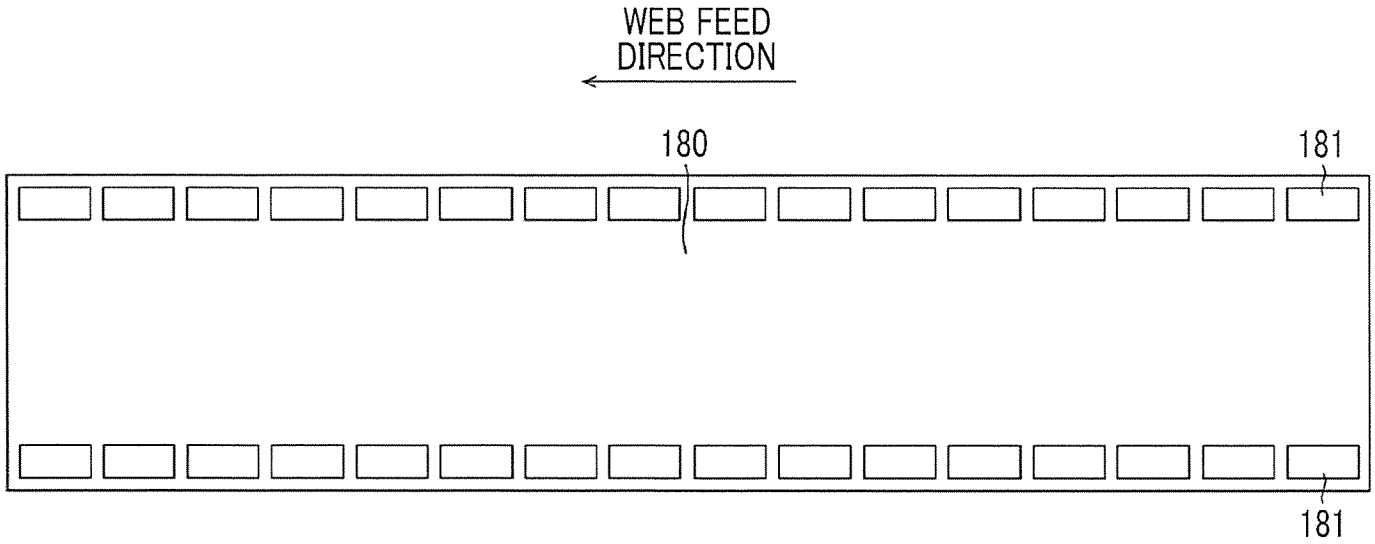
FIG. 21 is a plan view illustrating a form example of a web.
Figure 22:
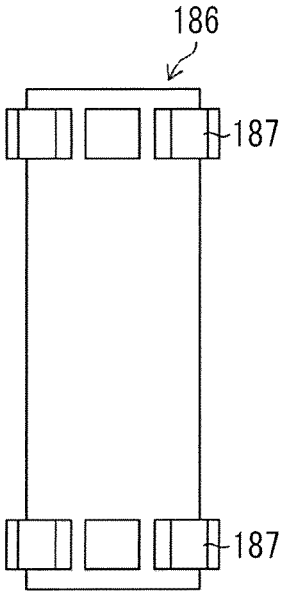
FIG. 22 is a top view of a winding shaft.
Figure 23:
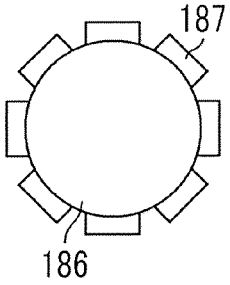
FIG. 23 is a front view of the winding shaft illustrated in FIG. 22.

As one of the methods of solving such a problem, a structure illustrated in FIGS. 21 and 22 is suggested. FIG. 21 is a plan view illustrating a form example of the web 180. FIG. 22 is a top view of the winding shaft 186 in the wiping unit 170. FIG. 23 is a front view of the winding shaft 186. As illustrated in FIG. 21, perforation-like feed holes 181 are formed at end parts of the web 180 in its width direction. The web 180 is transported in its longitudinal direction. A width direction of the web 180 is a width direction orthogonal to the longitudinal direction. The feed holes 181 are continuously formed at both the end parts of the web 180 so as to line up at regular intervals in parallel with a web feed direction. Additionally, a concavo-convex structure 187 including protrusions to be engaged with the feed holes 181 is formed in the surface of the winding shaft 186 of the wiping unit 170.

By virtue of the concavo-convex structure 187 and the feed holes 181 of the web 180, sticking or idling of the web 180 can be prevented, and the web 180 can be transported appropriately.

Study 2 Regarding Structure of Wiping Unit

Figure 24:
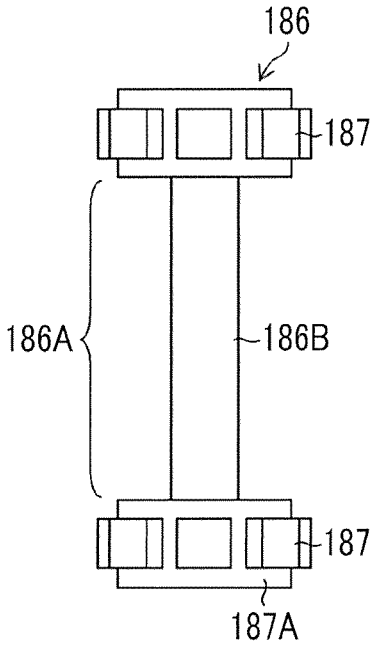
FIG. 24 is a top view illustrating another structural example of the winding shaft.
Figure 25:
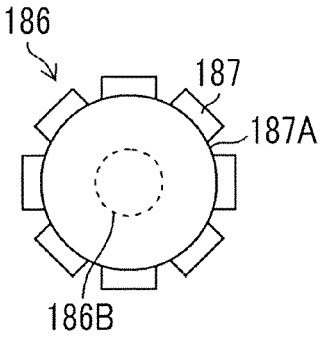
FIG. 25 is a front view of the winding shaft illustrated in FIG. 24.

FIGS. 24 and 25 are views illustrating another structural example of the winding shaft 186. In FIGS. 24 and 25, elements that are the same or similar to the configuration described in FIGS. 22 and 23 will be designated by the same reference signs, and the description thereof will be omitted. FIG. 24 is a top view illustrating the other structural example of the winding shaft 186, and FIG. 25 is a front view.

The winding shaft 186 illustrated in FIGS. 24 and 25 is an example of a structure in which a sticking suppressing effect of a web stuck is enhanced. The winding shaft 186 illustrated in FIGS. 24 and 25 has a non-contact portion 186B in which a shaft part 186A between concavo-convex structures provided on both sides in an axial direction corresponding to the feed holes 181 of the web 180 is in non-contact with the web 180. The external diameter of the non-contact portion 186B, becomes smaller than recesses 187A of concavo-convex structures 187 that come into contact with the web 180. When the shaft part 186A has the non-contact portion 186B with a smaller diameter than the recesses 187A, the contact area thereof with the web 180 decreases, the sticking is suppressed.

In a case where the sticking occurs due to the winding shaft 186 illustrated in FIGS. 22 and 23, it is preferable to perform web feed by machining the winding shaft 186 as illustrated in FIGS. 24 and 25 and lessening the contact area of the winding shaft with the web 180 to suppress the sticking.

Study 3 Regarding Structure of Wiping Unit

Figure 26:
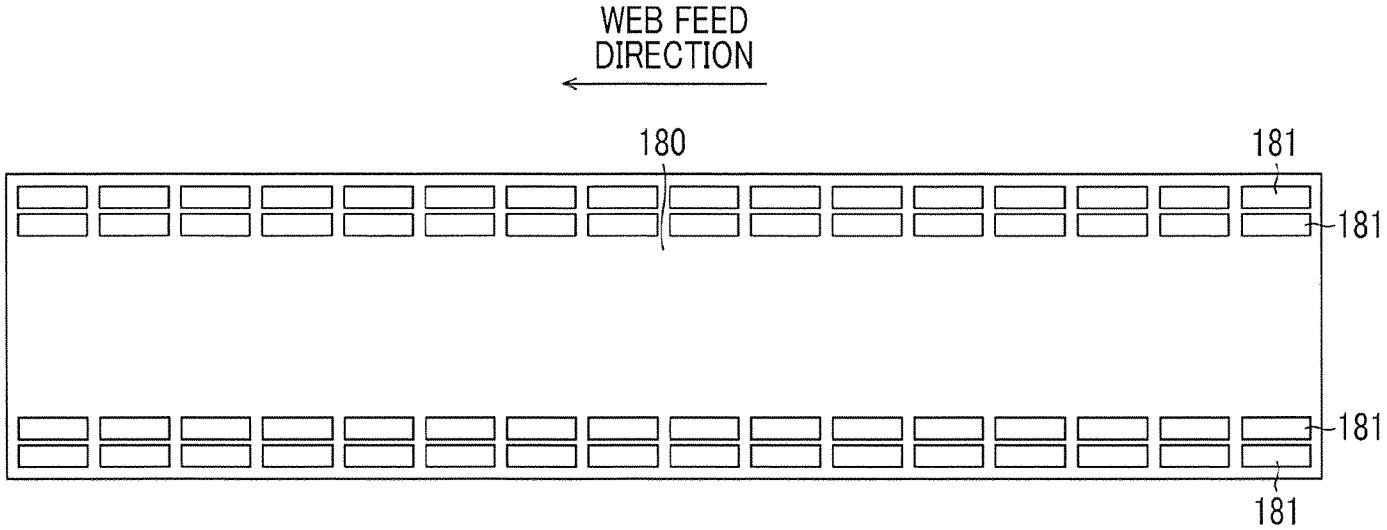
FIG. 26 is a plan view illustrating another form example of the web.
Figure 27:
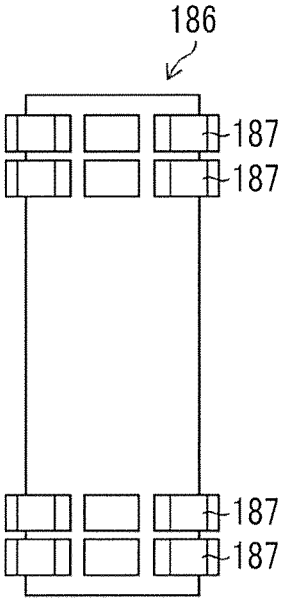
FIG. 27 is a top view illustrating another structural example of the winding shaft.

FIG. 26 is a plan view illustrating another form example of the web 180. FIG. 27 is a top view illustrating another structural example of the winding shaft 186. In FIGS. 26 and 27, elements that are the same or similar to the configuration described in FIGS. 22 and 23 will be designated by the same reference signs, and the description thereof will be omitted. The structure illustrated in FIGS. 26 and 27 is an example of a structure in which a suppressing effect of idling caused by slipping is enhanced.

In the web 180 illustrated in FIG. 26, two rows of perforation-like feed holes 181 are formed at end parts on both sides in a width direction, respectively. Additionally, in the winding shaft 186 illustrated in FIG. 27, two rows of concavo-convex structures 187 are formed on both sides in the width direction, respectively, in accordance with the feed holes 181 of the web 180 where is illustrated in FIG. 26.

In a case where idling caused by slipping occurs due to the winding shaft 186 illustrated in FIGS. 22 and 23, as illustrated in FIGS. 26 and 27, it is preferable to perform web feed by raising the force of increasing the feed holes 181 and the concavo-convex structures 187 in two rows on each side and transporting the web 180.

Additionally, a form in which the structure of the winding shaft 186 illustrated in FIG. 26 and FIG. 27 and the structure of the shaft part 186A having the non-contact portion 186B illustrated in FIGS. 24 and 25 are combined together is also possible.

Regarding Material of Winding Shaft 186

It is preferable that the winding shaft 186 corning into contact with the web 180 to which the cleaning liquid is applied is made of a chemical-resistant material and a water-repellent material.

Regarding Delivery Shaft 184 and Other Driving Shafts

Although a structural example of the winding shaft 186 is described in FIG. 22 to FIG. 25 and FIG. 27, the same structure regarding the delivery shaft 184 and other driving shafts for web transportation that is rotationally driven can be adopted.

Description of Control System of Ink Jet Recording Device 10

Figure 28:
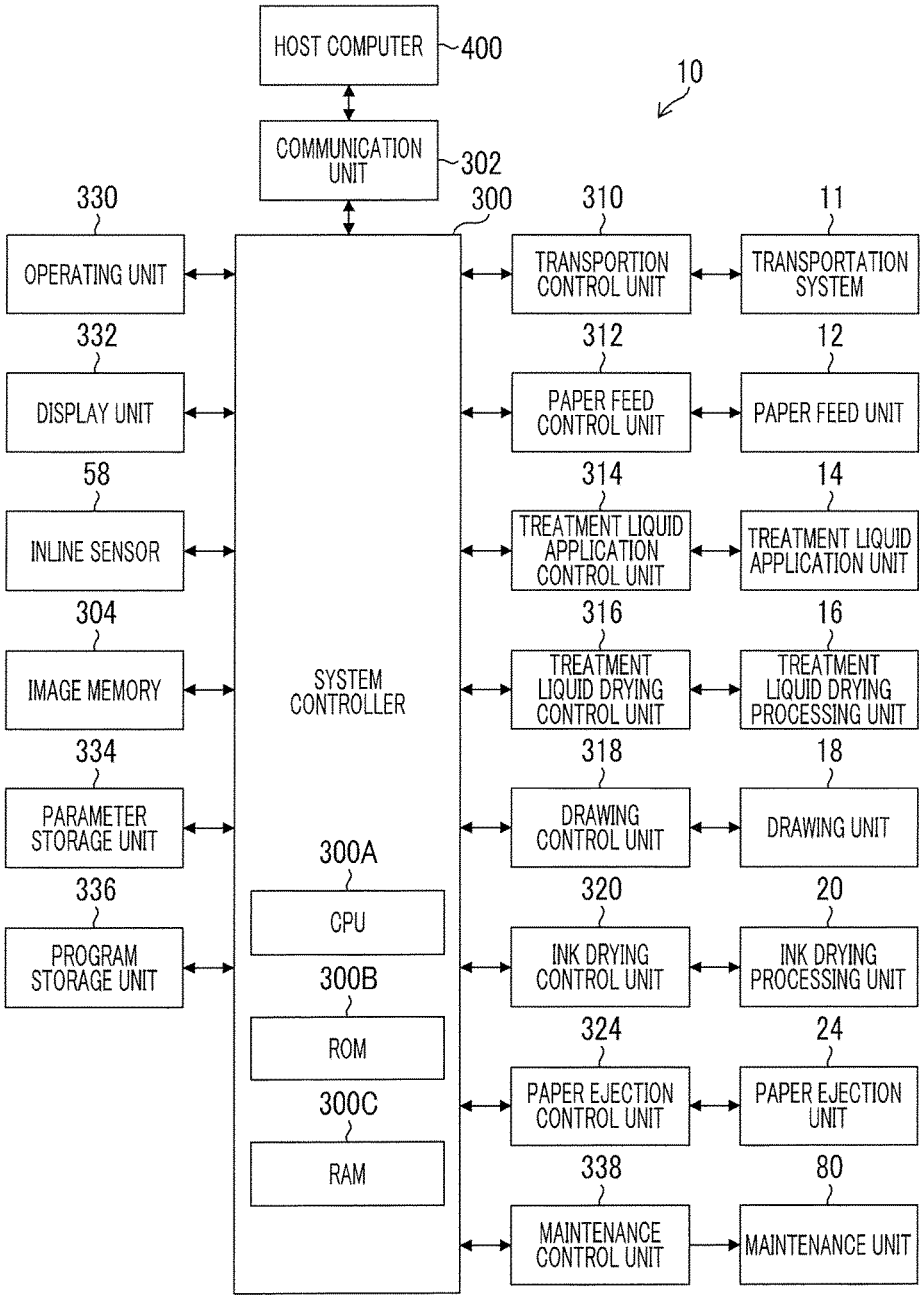
FIG. 28 is a block diagram illustrating a schematic configuration of a control system of the ink jet recording device.

FIG. 28 is a block diagram illustrating a schematic configuration of the control system of the ink jet recording device 10. The ink jet recording device 10 includes a system controller 300. The system controller 300 is configured to include a CPU 300A, a ROM 300B, and a RAM 300C. The CPU is an abbreviation of Central Processing Unit. The ROM is an abbreviation of Read Only Memory. The RAM is an abbreviation of Random Access Memory. In addition, memories, such as the ROM 300B and the RAM 300C, may be provided outside the system controller 300.

The system controller 300 functions as an entire control unit that generally controls respective units of the ink jet recording device 10. Additionally, the system controller 300 functions as a calculating unit that performs various kinds of calculation processing. Moreover, the system controller 300 functions as a memory controller that controls reading of data in the memories, such as the ROM 300B and the RAM 300C, and writing of the data.

The ink jet recording device 10 includes a communication unit 302, an image memory 304, a transportation control unit 310, a paper feed control unit 312, a treatment liquid application control unit 314, a treatment liquid drying control unit 316, a drawing control unit 318, an ink drying control unit 320, and a paper ejection control unit 324.

The communication unit 302 includes a communication interface (not illustrated), and is capable of transmitting and receiving data between the communication interface and a connected host computer 400.

The image memory 304 functions as a temporary storage unit for various data including image data. The image data taken in from the host computer 400 via the communication unit 302 is first stored in the image memory 304.

The transportation control unit 310 controls the operation of a transportation system 11 for the paper S in the ink jet recording device 10. The treatment liquid barrel 42, the treatment liquid drying processing barrel 46, the drawing barrel 52, and the chain gripper 64, which are illustrated in FIG. 1, are included in the transportation system 11.

The paper feed control unit 312 illustrated in FIG. 10 operates the paper feed unit 12 according to a command from the system controller 300. The paper feed control unit 312 controls supply start operation for the paper S, supply stop operation for the paper S, and the like.

The treatment liquid application control unit 314 operates the treatment liquid application unit 14 according to a command from the system controller 300. The treatment liquid application control unit 314 controls the application amount and the application timing of the treatment liquid, and the like.

The treatment liquid drying control unit 316 operates the treatment liquid drying processing unit 16 according to a command from the system controller 300. The treatment liquid drying control unit 316 controls drying temperature, the flow rate of drying gas, the injection timing of the drying gas, and the like.

The drawing control unit 318 controls the operation of the drawing unit 8 according to a command from the system controller 300.

The drawing control unit 318 is configured to include an image processing unit, a waveform generating unit, a waveform storage unit, and a drive circuit. Illustration of the image processing unit, the waveform generating unit, the waveform storage unit, and the drive circuit is omitted. The image processing unit forms dot data from input image data. The waveform generating unit generates the waveform of a driving voltage. The waveform of the driving voltage is stored in the waveform storage unit. The drive circuit generates a driving voltage having a driving waveform according to the dot data. The drive circuit supplies the driving voltage to a liquid discharge head.

In the image processing unit, color separation processing of separating the input image data into respective colors of RGB, color conversion processing of converting the RGB into CMYK, correction processing, such as gamma correction and unevenness correction, and half-tone processing of converting gradation values for respective pixels of each color into gradation values less than original gradation values are performed.

An example of the input image data includes raster data expressed by digital values of 0 to 255. The dot data obtained as the results of the half-tone processing may be binary values, or may be multiple values that are three or more values and are less than gradation values before half-tone processing.

The discharge timing of each pixel position and ink discharge amount are determined on the basis of the dot data generated through the processing performed by the image processing unit, a control signal that determines a driving voltage and the discharge timing of each pixel according to the discharge timing of each pixel position and the ink discharge amount are generated, the driving voltage is supplied to a liquid discharge head, and a dot is recorded with the ink discharged from the liquid discharge head.

The drawing control unit 318 may be provided with a correction processing unit (not illustrated). The correction processing unit executes correction processing on an abnormal nozzle. If the correction processing is performed, deterioration of image quality resulting from generation of the abnormal nozzle is suppressed.

The ink drying control unit 320 operates the ink drying processing unit 20 according to a command from the system controller 300. The ink drying control unit 320 controls the drying gas temperature, the flow rate of the drying gas, or the injection timing of the drying gas.

The paper ejection control unit 324 operates the paper ejection unit 24 according to a command from the system controller 300. The paper ejection control unit 324 controls the operation of the lifting mechanism according to an increase or decrease of the paper S, in a case where the paper ejection platform 76 illustrated in FIG. 1 includes the lifting mechanism.

The ink jet recording device 10 illustrated in FIG. 10 includes an operating unit 330, a display unit 332, a parameter storage unit 334, and a program storage unit 336.

The operating unit 330 has an operating member, such as an operation button, a keyboard, or a touch panel. A plurality of types of the operating members may be included in the operating unit 330. Illustration of the operating members is omitted.

Information input via the operating unit 330 is sent to the system controller 300. The system controller 300 executes various kinds of processing according to the information sent out from the operating unit 330.

The display unit 332 has a display device, such as a liquid crystal panel, and a display driver. Illustration of the display device and the display driver is omitted. The display unit 332 displays various kinds of setting information of the device, or various kinds of information, such as abnormality information, on the display device according to a command from the system controller 300. A user interface is constituted by the operating unit 330 and the display unit 332. A user is capable of performing setting of various parameters and inputting and editing of various kinds of information, using the operating unit 330 while viewing contents to be displayed on a screen of the display unit 332.

An operation screen for specifying the type of a web to be used for the head cleaning is displayed on the display unit 332, and the user is able to specify the type of the web by operating the operating unit 330. For example, the type names of the plurality of types of webs that are available as selection candidates in the ink jet recording device 10 are presented on the operation screen. The user performs the operation of selecting the type of a web to be actually used out of the selection candidates that are prepared in advance. The type of a web to be used for the wiping of the nozzle surface is specified according to this user operation. The combination of the operating unit 330 and the display unit 332 is equivalent to one form of "selecting and operating means". Additionally, the combination of the operating unit 330 and the display unit 332 is equivalent to one form of "type specifying means".

Various parameters to be used for the ink jet recording device 10 are stored in the parameter storage unit 334. The various parameters stored in the parameter storage unit 334 are read via the system controller 300, and are set in the respective units of the device. The information on the cleaning liquid application conditions for applying the respective saturated liquid amounts of the cleaning liquid of the plurality of types of webs, respectively, can be held in the parameter storage unit 334. For example, information on the operating conditions for the plurality of types of webs described in the drawing is held in the parameter storage unit 334. The parameter storage unit 334 is equivalent to one form of "condition information holding means".

Programs to be used for the respective units of the ink jet recording device 10 are stored in the program storage unit 336. The various programs stored in the program storage unit 336 are read via the system controller 300, and are executed in the respective units of the device.

The ink jet recording device 10 illustrated in FIG. 28 has the maintenance control unit 338. The maintenance control unit 338 controls the operation of the maintenance unit 80 according to a command from the system controller 300.

The operation of applying the cleaning liquid to the web 180, and the wiping operation performed by the web 180 are included in the operation of the maintenance unit 80 illustrated in the present embodiment. Additionally, purge processing, preliminary discharge, and the like of the liquid discharge head 56 may be included in the operation in the maintenance unit 80.

In FIG. 28, respective units are listed for respective functions in the ink jet recording device 10. The respective units illustrated in FIG. 28 are capable of being appropriately integrated, separated, combined, or omitted. The respective units illustrated in FIG. 28 can be configured by combining hardware and software appropriately.

Figure 29:
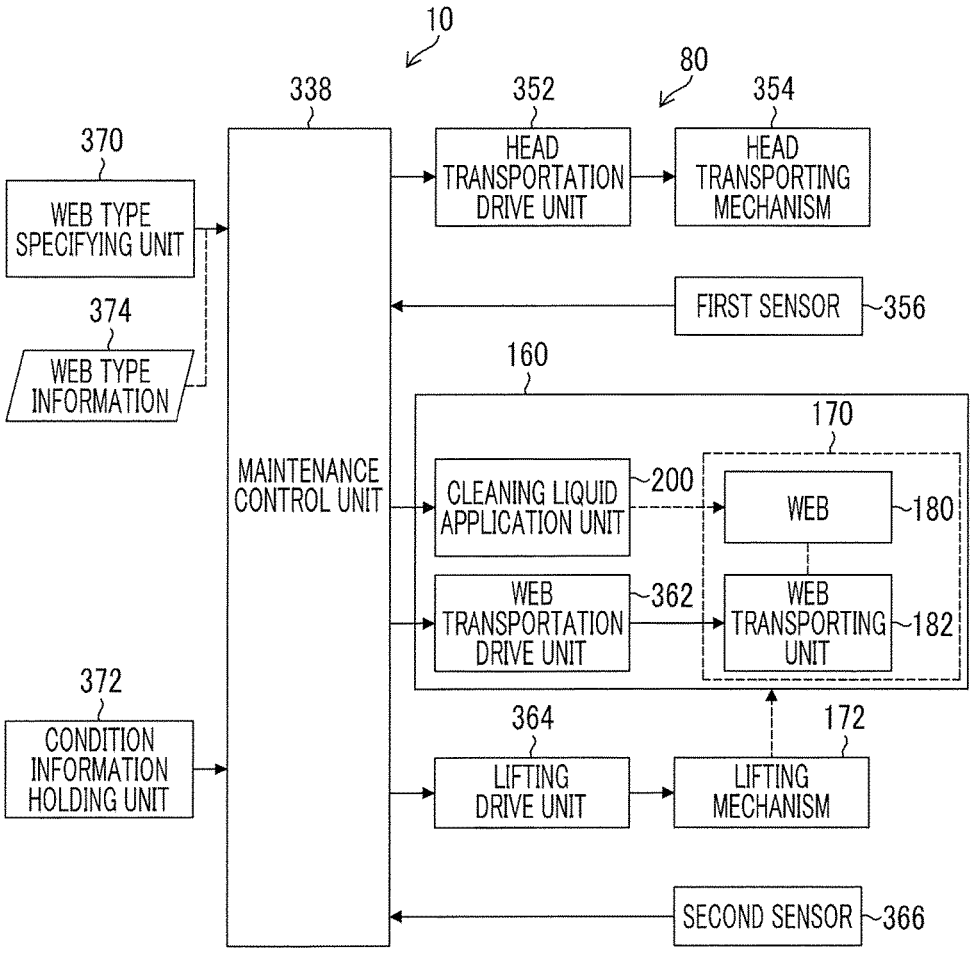
FIG. 29 is a block diagram of main units regarding the control of the maintenance unit in the ink jet recording device.

FIG. 29 is a block diagram of main units regarding the control of the maintenance unit 80 in the ink jet recording device 10.

The ink jet recording device 10 includes a head transportation drive unit 352 and a head transporting mechanism 354. The head transporting mechanism 354 is a mechanism that moves the liquid discharge head 56 between the image recording position and the maintenance position that are described in FIG. 2. The head transportation drive unit 352 is configured to include a motor serving as a driving source that moves the liquid discharge head 56 with the head transporting mechanism 354. The maintenance control unit 338 sends a control signal to the head transportation drive unit 352, and controls the movement of the liquid discharge head 56 in the X direction.

The ink jet recording device 10 may include a first sensor 356 for detecting the position of the liquid discharge head 56 in the X direction. A detection signal of the first sensor 356 is sent to the maintenance control unit 338. The maintenance control unit 338 is capable of ascertaining a relative positional relationship between the liquid discharge head 56 and the wiping unit 170 on the basis of the detection signal from the first sensor 356.

The nozzle surface wiping device 160 includes the web 180, the web transporting unit 182, a web transportation drive unit 362, and the cleaning liquid application unit 200. The web transportation drive unit 362 includes a motor serving as a power source for transporting the web 180 along a web transporting path formed by the web transporting unit 182. When the web transportation drive unit 362 is driven, the winding shaft 186 described in FIG. 4 rotates and winding of the web 180 is performed. In addition, the web transportation drive unit 362 may be installed outside the wiping unit 170. The maintenance control unit 338 sends a control signal to the web transportation drive unit 362, and controls traveling of the web 180.

The ink jet recording device 10 includes a lifting mechanism 172 for moving the wiping unit 170 in a Z direction, and a lifting drive unit 364. The lifting drive unit 364 includes a motor serving as a power source that moves the lifting mechanism 172 upward and downward. The maintenance control unit 338 controls the driving of the lifting drive unit 364, and controls the movement of the wiping unit 170 in the Z direction.

The ink jet recording device 10 may include a second sensor 366 for detecting the position of the wiping unit 170 in the Z direction. A detection signal of the second sensor 366 is sent to the maintenance control unit 338. The maintenance control unit 338 is capable of ascertaining a relative distance between the nozzle surface 57 of the liquid discharge head 56 and the web 180 of the wiping unit 170, on the basis on the detection signal from the second sensor 366.

The ink jet recording device 10 includes a web type specifying unit 370 that specifies the type of the web 180, and a condition information holding unit 372 that holds information on the cleaning liquid application conditions of the plurality of types of webs. The web type specifying unit 370 can be constituted by a user interface consisting of the operating unit 330 and the display unit 332 that are described in FIG. 28. Additionally, the web type specifying unit 370 may be means for automatically identifying the type of the web 180 of the wiping unit 170. For example, a configuration in which identification information is given to the case 183 of the wiping unit 170 with a bar code, a wireless tag, or the like, and the type of the web 180 is automatically discriminated by reading the identification information with a bar code reader, a wireless tag reader, or the like may be adopted.

The condition information holding unit 372 is a portion of a storage region of the parameter storage unit 334 described in FIG. 28. The information on the cleaning liquid application conditions for applying the respective saturated liquid amounts of the cleaning liquid to the plurality of types of webs, respectively, is held in the condition information holding unit 372.

The maintenance control unit 338 acquires information on cleaning liquid application conditions of a corresponding web type from the condition information holding unit 372, on the basis of web type information 374 specified by the web type specifying unit 370, and determines cleaning liquid application conditions of the web 180 to be used. The maintenance control unit 338 controls the cleaning liquid application unit 200 and the web transportation drive unit 362 according to the determined cleaning liquid application conditions.

The maintenance control unit 338 is equivalent to one form of "control means". Otherwise, the combination of the system controller 300 and the maintenance control unit 338 may be understood to be equivalent to one form of the "control means".

Head Cleaning Method Related to Embodiment

Figure 30:
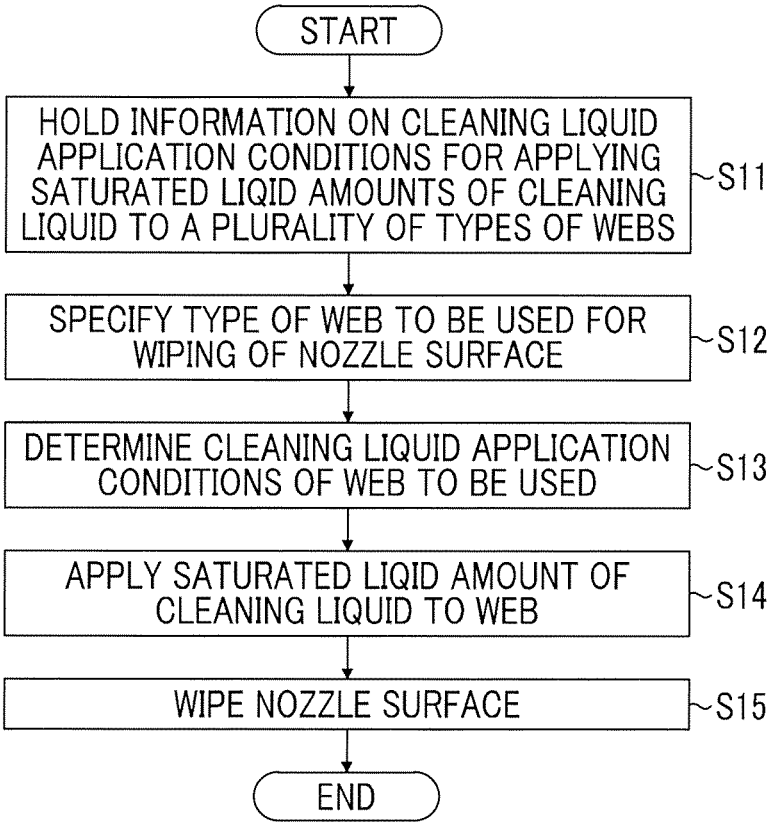
FIG. 30 is a flowchart of a head cleaning method to be executed by the ink jet recording device.

FIG. 30 is a flowchart of a head cleaning method executed by the ink jet recording device 10.

In Step S11, the condition information holding unit 372 of the ink jet recording device 10 holds the information on the cleaning liquid application conditions for applying the saturated liquid amounts of the cleaning liquid to the respective webs regarding the plurality of types of webs. As described in FIG. 17, the cleaning liquid application conditions for applying the respective saturated liquid amounts of the cleaning liquid to the respective webs according to the types of the plurality of types of webs are determined in advance, and the information on the cleaning liquid application conditions for the respective types of the webs is held in the condition information holding unit 372. Step S11 is equivalent to one form of a "condition information holding step".

In Step S12, the maintenance control unit 338 specifies the type of a web to be used for the wiping of the nozzle surface. The maintenance control unit 338 specifies the type of the web through an automatic web type discrimination function using a user's selecting operation or identification information. Step S12 is equivalent to one form of a "type specifying step".

In Step S13, the maintenance control unit 338 determines cleaning liquid application conditions of the web to be used. The maintenance control unit 338 acquires information on cleaning liquid application conditions of a corresponding web type from the condition information holding unit 372, on the basis of the web type information 374, and determines the cleaning liquid application conditions of the web to be used. Step S13 is equivalent to one form of a "condition determination step".

In Step S14, the maintenance control unit 338 controls the cleaning liquid application unit 200 and the web transportation drive unit 362 according to the determined cleaning liquid conditions, and applies a saturated liquid amount of the cleaning liquid to the web. Step S14 is equivalent to one form of a "cleaning liquid application step".

In Step S15, the maintenance control unit 338 controls the head transportation drive unit 352, the cleaning liquid application unit 200, and the web transportation drive unit 362, brings the web, in a state where the saturated liquid amount of the cleaning liquid is applied, into contact with to the nozzle surface, and wipes the nozzle surface. Step S15 is equivalent to one form of a "wiping step".

Configuration Example of Liquid Discharge Head

Next, a configuration example of the liquid discharge head 56 will be described.

Figure 31:
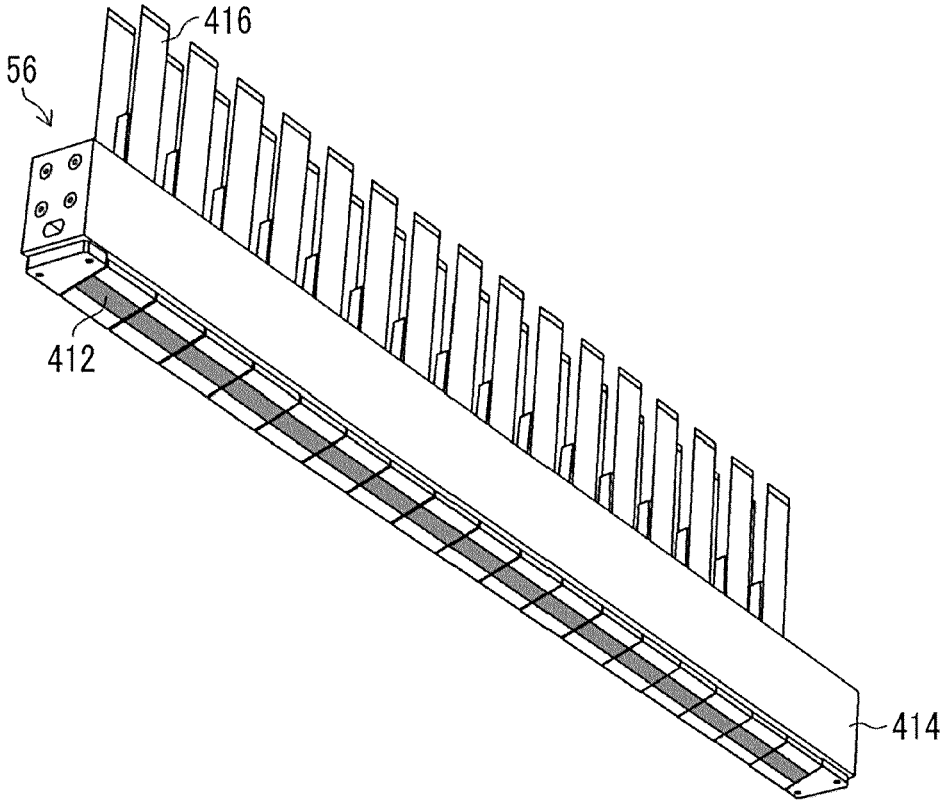
FIG. 31 is a perspective view illustrating a configuration example of a liquid discharge head.

FIG. 31 is a perspective view of the liquid discharge head 56. An aspect in which the discharge surface is looked up from an oblique downward direction of the liquid discharge head 56 is illustrated in FIG. 31. The liquid discharge head 56 becomes an ink jet head bar in which a plurality of head modules 412 are lined up and lengthened in a paper width direction.

Although an example in which seventeen head modules 412 are connected together is illustrated in FIG. 31, the structure of the head modules 412 and the number and the array form of the head modules 412 is not limited to the illustrated example. Reference sign 414 in the drawing designates a base frame serving as a frame body for coupling and fixing the plurality of head modules 412 in the shape of a bar. Reference sign 416 designates a flexible substrate connected to each head modules 412. One liquid discharge head 56 is configured by the plurality of head modules 412 being attached to the base frame 414 and integrated.

Figure 32:
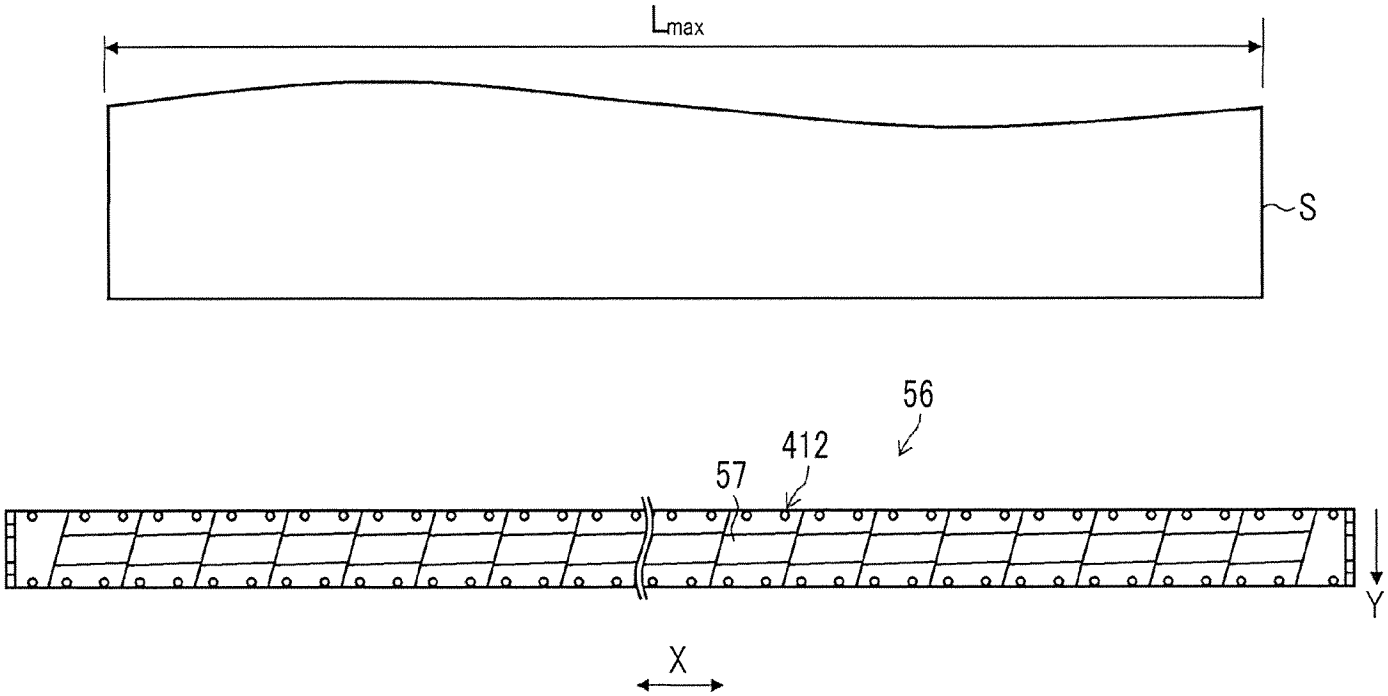
FIG. 32 is a plan schematic view of the liquid discharge head.

FIG. 32 is a plan view of the nozzle surface 57 of the liquid discharge head 56. The liquid discharge head 56 has a structure in which a plurality of nozzles are disposed over a length exceeding a full width Lmax of the paper S in the direction orthogonal to the paper transporting direction. Illustration of the nozzles is omitted in FIG. 32. The nozzles are illustrated using reference sign 480 in FIG. 34.

A direction illustrated using reference sign X in FIG. 32 is the direction orthogonal to the paper transporting direction. A direction illustrated using reference sign Y in FIG. 32 is the paper transporting direction. The direction orthogonal to the paper transporting direction is the X direction. The paper transporting direction may be described as the Y direction.

The same configuration may be applied to the plurality of head modules 412. Additionally, a structure in which a single head module 412 can be made to function as a liquid discharge head may be provided.

Although the liquid discharge head 56 in which the plurality of head modules 412 are disposed as an example is illustrated in the paper width direction in FIG. 32, the plurality of head modules 412 may be disposed in two rows such that the positions thereof deviate from each other in the paper transporting direction.

Structural Example of Head Module

Figure 33:
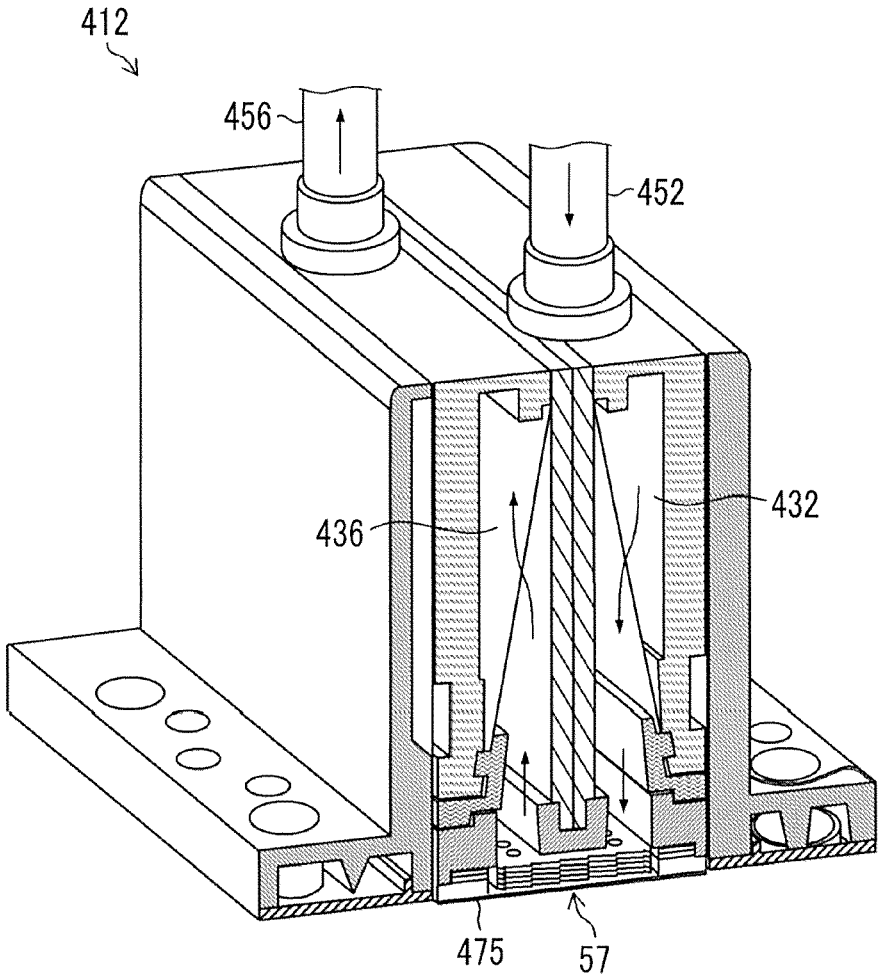
FIG. 33 is a perspective view of the head module, and is a view including a partial cross-sectional view.
Figure 34:
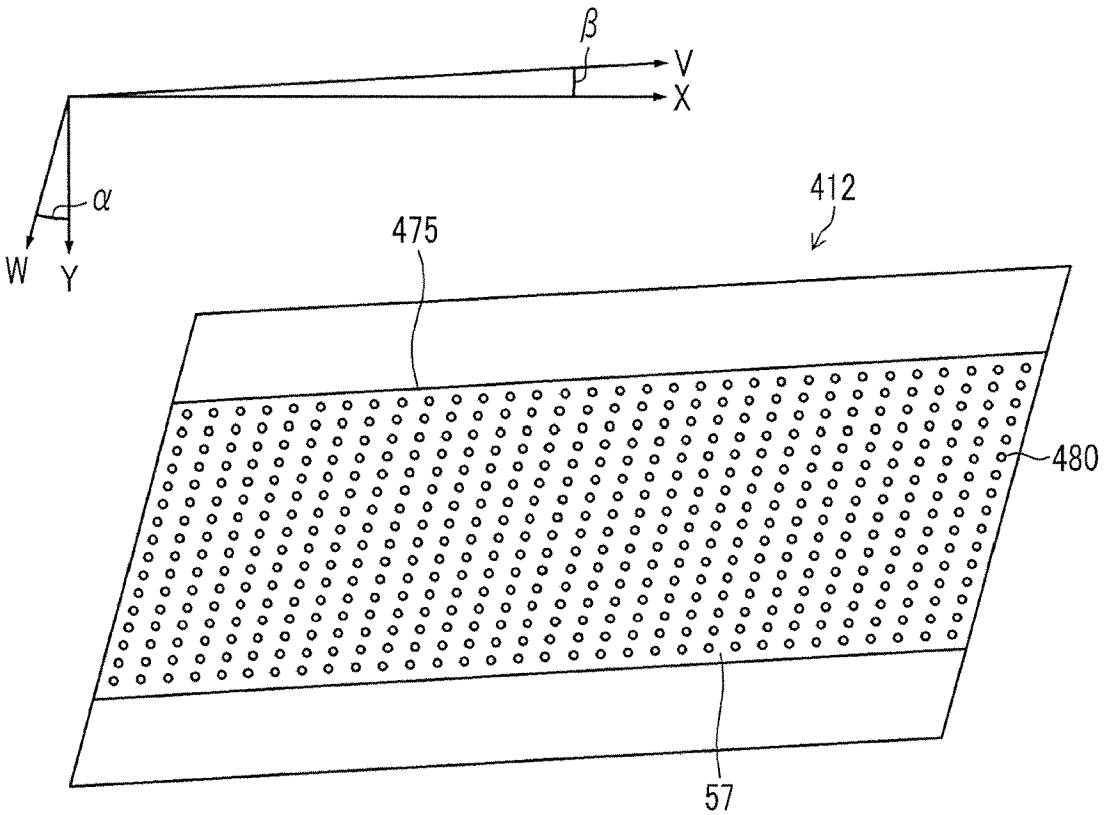
FIG. 34 is a perspective plan view of a nozzle surface in the head module.

Next, a head module 412 will be described in detail. FIG. 33 is a perspective view of the head module 412, and is a view including a partial cross-sectional view. FIG. 34 is a plan view of the discharge surface in the head module 412. As illustrated in FIG. 33, the head module 412 includes an ink supply chamber 432 and an ink circulation chamber 436.

The ink supply chamber 432 and the ink circulation chamber 436 are disposed opposite to the nozzle surface 57 of a nozzle plate 475. The ink supply chamber 432 is connected to an ink tank (not illustrated) via a supply line 452. The ink circulation chamber 436 is connected to a recovery tank (not illustrated) via a circulation line 456.

The number of the nozzles 480 is omitted in FIG. 34. Openings of the plurality of nozzles 480 are disposed in a two-dimensional arrangement on the nozzle surface 57 that has the nozzle plate 475 of one head module 412.

That is, the head module 412 is formed in a parallelogrammatic planar shape having an end surface on the side of a long side extending in a V direction that has an inclination of an angle β with respect to the X direction, and an end surface on the side of a short side extending in a W direction having an inclination of an angle α with respect to the Y direction, and the plurality of nozzles 480 are arranged in a matrix in a row direction that is the V direction and a column direction that is the W direction.

The arrangement of the nozzles 480 is not limited to the form illustrated in FIG. 34, and the plurality of nozzles 480 may be arranged in the row direction that is the X direction and in a column direction that obliquely intersects the X direction.

In the case of a liquid discharge head having a two-dimensional nozzle array, a projection nozzle row obtained by projecting respective nozzle openings in a two-dimensional nozzle array so as to line up in the X direction (orthogonal projection) can be considered to be equivalent to one nozzle row in which respective nozzles are lined up at approximately equal intervals in a nozzle density that achieves a maximum recording resolution in the X direction. The "approximately regular intervals" means being substantially regular intervals as droplet hitting points that are recordable with the ink jet recording device. For example, also a case where nozzles or the like of which intervals are made slightly different from each other in consideration of movement of droplets on the paper caused by a manufacturing error or landing interference are included is included in the concept of the "equal intervals". If the projection nozzle row (also referred to as a "substantial nozzle row") is taken into consideration, nozzle numbers showing nozzle positions can be associated with the projection nozzles, which are lined up in the X direction, in the line-up order thereof.

In the liquid discharge head 56 illustrated in the present embodiment, in a connected portion between the head modules 412 adjacent to each other in the projection nozzle row in the X direction, the nozzles 480 belonging to one head module 412 and the nozzles 480 belonging to the other head module 412 are present in a mixed manner.

Internal Structure of Head Module

Figure 35:
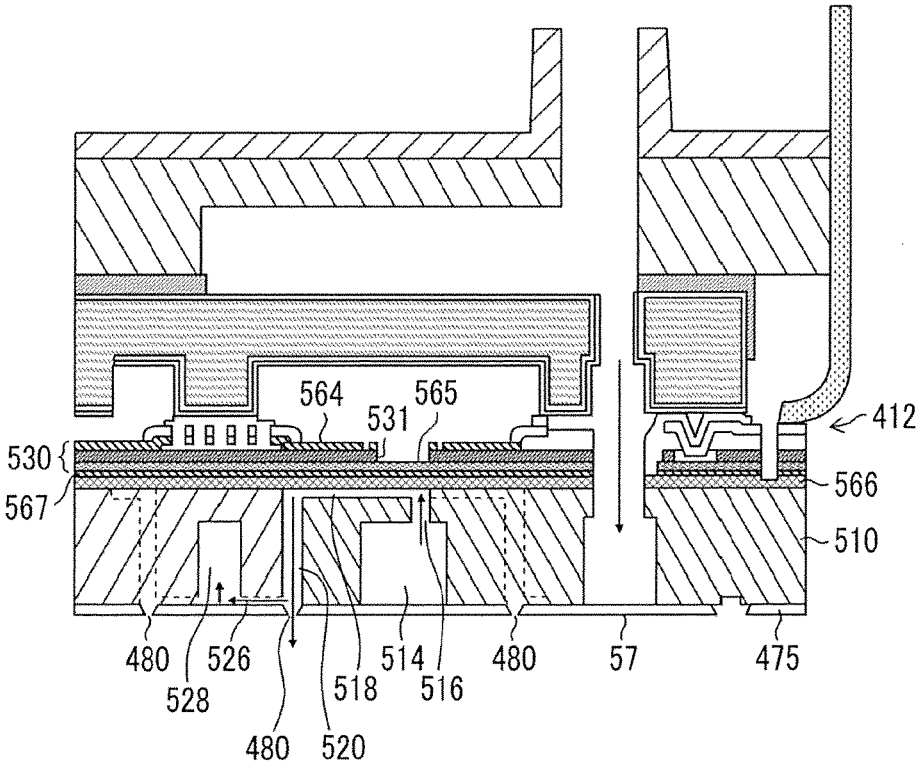
FIG. 35 is a cross-sectional view illustrating the internal structure of the head module.

FIG. 35 is a cross-sectional view illustrating the internal structure of a head module 412. The head module 412 includes an ink supply passage 514, an individual supply passage 516, a pressure chamber 518, a nozzle communication passage 520, an individual circulation flow passage 526, a common circulation flow passage 528, a piezoelectric element 530, and a vibration plate 566.

The ink supply passage 514, the individual supply passage 516, the pressure chamber 518, the nozzle communication passage 520, the individual circulation flow passage 526, and the common circulation flow passage 528 are formed in a flow passage structure 510. The individual supply passage 516 is a flow passage that connects the pressure chamber 518 and the ink supply passage 514 together. The nozzle communication passage 520 is a flow passage that connects the pressure chamber 518 and a nozzle 480 together. The individual circulation flow passage 526 is a flow passage that connects the nozzle communication passage 520 and the common circulation flow passage 528 together.

The vibration plate 566 is provided on the flow passage structure 510. The piezoelectric element 530 is disposed on the vibration plate 566 via an adhesive layer 567. The piezoelectric element 530 has a laminated structure of a lower electrode 565, a piezoelectric body layer 531, and an upper electrode 564. In addition, the lower electrode 565 may be referred to as a common electrode and the upper electrode 564 may be referred to as an individual electrode.

The upper electrode 564 is an individual electrode patterned to correspond to the shape of each pressure chamber 518, and the piezoelectric element 530 is provided for each pressure chamber 518.

The ink supply passage 514 is connected to the ink supply chamber 432 described in FIG. 33. Ink is supplied from the ink supply passage 514 via the individual supply passage 516 to the pressure chamber 518. If a driving voltage is applied to the upper electrode 564 of the piezoelectric element 530 to be operated according to image data, the piezoelectric element 530 and the vibration plate 566 are deformed and the volume of the pressure chamber 518 varies.

The head module 412 is capable of discharging ink droplets from the opening of the nozzle 480 via the nozzle communication passage 520 due to a pressure change accompanying a change in the volume of the pressure chamber 518.

In the head module 412, the driving of the piezoelectric element 530 corresponding to each nozzle 480 is controlled according to dot data generated from the image data.

A desired image is formed on the paper S by controlling the discharge timing of an ink droplet from each nozzle 480 in accordance with the transporting speed of the paper S while transporting the paper S illustrated in FIG. 32 in a paper transporting direction at a constant speed.

The nozzle communication passage 520 communicates with the individual circulation flow passage 526, and the ink that is not used for discharge in the ink supplied from the nozzle communication passage 520 to the nozzle 480 is recovered to the common circulation flow passage 528 via the individual circulation flow passage 526.

The common circulation flow passage 528 is connected to the ink circulation chamber 436 described in FIG. 33. By always recovering ink to the common circulation flow passage 528 through the individual circulation flow passage 526, an increase in the viscosity of the ink within the nozzle 480 in a non-discharge period is prevented.

Regarding Discharge Method

Regarding a discharge method of the liquid discharge head 56, the means for generating discharge energy is not limited to the piezoelectric element, and various discharge energy generation elements, such as a heater element and an electrostatic actuator, may be applied. For example, a method of discharging droplets by using the pressure of film boiling caused by heating of a liquid by the heater element can be adopted. According to the discharge method of the liquid discharge head, a suitable discharge energy generation element is provided in the flow passage structure.

Advantages of Embodiment

According to the present embodiment, since the application amount of the cleaning liquid is appropriately controlled according to the type of a web to be used, breaking of the meniscus can be prevented. According to the present embodiment, a plurality of types of webs can be used properly, and it is possible to broaden alternatives of the types of the webs.

Modification Example 1

Although a beltlike web has been illustrated as a wiping member in the above-described embodiment, the invention can be applied to various wiping members having liquid absorptivity.

Modification Example 2

A configuration in which the plurality of types of webs are loaded in one ink jet recording device is also possible, and the cleaning liquid application conditions just have to be determined so as to apply the respective saturated liquid amounts of the cleaning liquid to the respective webs to be loaded onto the device.

Modification Example 3

Although a configuration in which drawing is performed by transporting paper to a stopped liquid discharge head, thereby relatively moving the liquid discharge head and the paper, has been illustrated in the above-described embodiment, a configuration in which a liquid discharge head is moved with respect to stopped paper is also possible when carrying out the invention. In addition, although the single pass type line head generally is disposed in the direction orthogonal to the paper transporting direction, an aspect in which the line head is disposed in an oblique direction to which a certain angle is given with respect to the direction orthogonal to the paper transporting direction may also be adopted.

Additionally, although the full line type ink jet recording device 10 has been illustrated in the above-described embodiment, an ink jet recording device in which a short liquid discharge head that is less than the width of the paper is scanned in the paper width direction to perform printing in the same direction, a given amount of paper is moved to perform printing in the width direction of the paper on the next region, and a serial head that repeats this operation to perform printing on the paper is used can also be applied when carrying out the invention.

The items described in the configuration described in the above-described embodiment and the modification examples can be combined appropriately and used, and some items can also be replaced with other.

Regarding Transporting Means for Paper

The transporting means for transporting the paper S is not limited to the drum transmission type illustrated in FIG. 1, and various forms, such as a belt transmission type, a nip transmission type, a chain transmission type, and a pallet transportation type, can be adopted, and these types can be combined appropriately.

Regarding Terms

The "wiping" is one aspect of cleaning.

Aspects in which the same effects as those in a case where intersection is made at an angle of substantially 90° among aspects in which intersection is made at an angle of less than 90° or at an angle of more than 90° are generated is included in the term "orthogonal" or "perpendicular" in the present specification.

"Substantial parallel" in which, although two directions intersect each other, the same effects as those in "parallel" are exhibited, are included in the term "parallel" in the present specification. That is, an allowable range where, although something is strictly non-parallel, it can be regarded and treated as being "substantially parallel", is included in the "parallel".

The term "barrel" in the present specification is synonymous with a "drum". The drum is a transporting member that has a cylindrical shape and holds at least a portion of a medium to rotate about a central axis of the cylindrical shape, thereby transporting the medium along an outer peripheral surface of the cylindrical shape.

The term "paper" in the present specification is used in the same meaning as the "medium" to which the liquid discharged from a liquid discharge head is made to adhere. The "paper" is synonymous with terms, such as recording media, printing paper, recording paper, printing media, media to be printed, media to be recorded, image forming media, media to be image-formed, image receiving media, or media to be discharged. The material, shape, and the like of the medium are not limited, resin sheets, films, cloth, non-woven fabrics, and other materials may be adopted in addition to the paper material, and various forms, such as continuous paper, sheetlike cut paper (sheet paper), and seal paper, may be adopted.

The "image" shall be interpreted in a broad sense, and color images, monochrome images, single color images, gradation images, uniform-density (solid) images, or the like are also included in the "image". The "image" is not limited to photographic images, and is used as a comprehensive term including patterns, characters, symbols, line drawings, mosaic patterns, color-toned patterns, other various patterns, or suitable combinations thereof. The "printing" includes the concepts of terms, such as character printing, recording of images, formation of images, drawing, and print.

The term "recording device" is synonymous with terms, such as printing devices, printing machines, printers, image recording devices, drawing devices, or image forming devices.

Application Examples to Other Devices

In the above embodiment, the application to the ink jet recording device for graphic printing has been described as an example. However, the application range of the invention is not limited to this example. For example, the invention can also be broadly applied to liquid discharge apparatuses capable of obtaining various shapes and patterns using liquid functional materials, such as wiring line drawing apparatuses that draw wiring patterns of electronic circuits, apparatuses for manufacturing various devices, registration printing apparatuses using a resin liquid as a functional liquid for discharge, color filter manufacturing apparatuses, and fine structure forming apparatuses that form fine structures using materials for material deposition.

In the embodiment of the invention described above, the constituent elements can be appropriately changed, added, and eliminated without departing from the scope of the invention. The invention is not limited to the embodiment described above, and many alterations deformation is possible by a person having ordinary knowledge in this art in question within the technical idea of the invention.

EXPLANATION OF REFERENCES

10: ink jet recording device
11: transportation system
12: paper feed unit
14: treatment liquid application unit
16: treatment liquid drying processing unit
18: drawing unit
20: ink drying processing unit
20: temperature
24: paper ejection unit
30: paper feed platform
32: paper feeder
34: paper feed roller pair
36: feeder board
36A: retainer
36B: guide roller
40: paper feed barrel
40A: gripper
40B: rotating shaft
42: treatment liquid barrel
42A: gripper
42C: outer peripheral surface
44: treatment liquid applicator
45: relative humidity
46: treatment liquid drying processing barrel
46A: gripper
46C: outer peripheral surface
48: paper transportation guide
50: relative humidity
50: treatment liquid drying processing unit
52: drawing barrel
52A: gripper
52B: rotating shaft
52C: outer peripheral surface
54: roller
56, 56C, 56M, 56Y, 56K: liquid discharge head
57: nozzle surface
58: inline sensor
64: chain gripper
64A: first sprocket
64B: second sprocket
64C: chain
64D: gripper
68: ink drying processing unit
72: guide plate
73: guide plate
76: paper ejection platform
80: maintenance unit
90: head supporting frame
92: bearing
94: body frame
96L: side plate
96R: side plate
98: coupling frame
102: attaching part
104: part to be attached
110: moisturizing unit
120C: cap
120K: cap
120M: cap
120Y: cap
130: waste liquid tray
132: waste liquid recovery pipe
134: waste liquid tank
160: nozzle surface wiping device
162: wiping device body frame
170, 170C, 170M, 170Y, 170K: wiping unit
172, 172C: lifting mechanism
180: web
181: feed hole
182: web transporting unit

183: case
184: delivery shaft
186: winding shaft
186A: shaft part
186B: non-contact portion
187: concavo-convex structure
187A: recess
188: first guide roller
190: pressing roller
192: second guide roller
200: cleaning liquid application unit
202: cleaning liquid supply nozzle
210: cleaning liquid supply unit
212: cleaning liquid tank
214: cleaning liquid flow passage
216: cleaning liquid pump
220: foreign matter
222: air bubble
224: ink
226: meniscus
300: system controller
302: communication unit
304: image memory
310: transportation control unit
312: paper feed control unit
314: treatment liquid application control unit
316: treatment liquid drying control unit
318: drawing control unit
320: ink drying control unit
324: paper ejection control unit
330: operating unit
332: display unit
334: parameter storage unit
336: program storage unit
338: maintenance control unit
352: head transportation drive unit
354: head transporting mechanism
356: first sensor
362: web transportation drive unit
364: lifting drive unit
366: second sensor
370: web type specifying unit
372: condition information holding unit
374: web type information
400: host computer
412: head module
414: base frame
416: flexible substrate
432: ink supply chamber
436: ink circulation chamber
452: supply line
456: circulation line
475: nozzle plate
480: nozzle
510: flow passage structure
514: ink supply passage
516: individual supply passage
518: pressure chamber
520: nozzle communication passage
526: individual circulation flow passage
528: common circulation flow passage
530: piezoelectric element
531: piezoelectric body layer
564: upper electrode
565: lower electrode
566: vibration plate
567: adhesive layer
S: paper
S11 TO S15: steps of head cleaning method

What is claimed is:

1. A nozzle surface wiping device comprising:

a cleaning liquid application unit configured to apply a cleaning liquid to a wiping member that wipes a nozzle surface of a liquid discharge head;

a condition information holding unit configured to hold, in advance, information on cleaning liquid application conditions for applying respective saturated liquid amounts of the cleaning liquid to a plurality of types of wiping members, respectively, according to the types of the wiping members;

a type specifying unit configured to specify the type of a wiping member to be used for the wiping of the nozzle surface; and a control unit configured to control an amount of the cleaning liquid to be applied to the wiping member according to the type of the wiping member specified by the type specifying unit, wherein the control unit performs a control of determining the cleaning liquid application conditions corresponding to the type of the wiping member to be used for the wiping of the nozzle surface, based on the type of the wiping member specified by the type specifying unit and the information held in the condition information holding unit, and applies a saturated liquid amount of the cleaning liquid to the wiping member according to the determined cleaning liquid application conditions, wherein the wiping member is a beltlike web, and the nozzle surface wiping device further comprises a web transporting unit configured to make the web travel in a longitudinal direction of the web, wherein, in a case where a feed speed of the web by the web transporting unit is defined as v millimeters per second, a feed time of the web by the web transporting unit is defined as t seconds, a web width in a width direction orthogonal to the longitudinal direction of the web is defined w millimeters, a saturated absorbed liquid amount per unit area of the web is defined as C milliliters per square millimeters, and an application amount of the cleaning liquid by the cleaning liquid application unit is defined as L milliliters, the control unit performs a control of being the application amount of the cleaning liquid that satisfies $L \geq v \times t \times w \times C$.

2. The nozzle surface wiping device according to claim 1, wherein the nozzle surface is wiped by relatively moving the wiping member and the liquid discharge head while the wiping member to which the saturated liquid amount of the cleaning liquid is applied is made to travel with the web transporting unit.

3. The nozzle surface wiping device according to claim 1, wherein the cleaning liquid application unit includes a cleaning liquid supply nozzle that adds the cleaning liquid dropwise onto the wiping member, and a tube pump that supplies the cleaning liquid to the cleaning liquid supply nozzle, and wherein the control unit controls a dropping amount per unit time of the cleaning liquid that is added dropwise from the cleaning liquid supply nozzle by controlling a voltage that drives the tube pump.

4. The nozzle surface wiping device according to claim 1, wherein the type specifying unit includes a selecting and operating unit configured to select the type of a wiping member to be used for the wiping of the nozzle surface from the plurality of types of wiping members that are prepared in advance, and wherein the control unit determines the corresponding cleaning liquid application conditions from the information holding the condition information holding unit, based on the type of the wiping member selected by the selecting and operating unit.

5. A liquid discharge apparatus comprising:

the nozzle surface wiping device according to claim 1;

the liquid discharge head having the nozzle surface where openings of a plurality of nozzles that discharge a liquid are arrayed; and a relative movement unit configured to relatively move the liquid discharge head and the wiping member in a state where the nozzle surface and the wiping member come in contact with each other.

6. A nozzle surface wiping device comprising:

a cleaning liquid application unit configured to apply a cleaning liquid to a wiping member that wipes a nozzle surface of a liquid discharge head;

a condition information holding unit configured to hold, in advance, information on cleaning liquid application conditions for applying respective saturated liquid amounts of the cleaning liquid to a plurality of types of wiping members, respectively, according to the types of the wiping members;

a type specifying unit configured to specify the type of a wiping member to be used for the wiping of the nozzle surface; and a control unit configured to control an amount of the cleaning liquid to be applied to the wiping member according to the type of the wiping member specified by the type specifying unit, wherein the control unit performs a control of determining the cleaning liquid application conditions corresponding to the type of the wiping member to be used for the wiping of the nozzle surface, based on the type of the wiping member specified by the type specifying unit and the information held in the condition information holding unit, and applies a saturated liquid amount of the cleaning liquid to the wiping member according to the determined cleaning liquid application conditions, wherein the wiping member is a beltlike web, and the nozzle surface wiping device further comprises a web transporting unit configured to make the web travel in a longitudinal direction of the web and a winding shaft that winds the web by being rotationally driven, wherein the web has feed holes for transportation in the longitudinal direction, at an end part in a width direction orthogonal to the longitudinal direction, and wherein the winding shaft has a concavo-convex structure including protrusions to be engaged with respect to the feed holes.

7. The nozzle surface wiping device according to claim 6, wherein a shaft part between the concavo-convex structures that are respectively provided at end parts on both sides in the width direction of the winding shaft has a non-contact portion that is in non-contact with the web, and wherein the non-contact portion has a smaller diameter than recesses of the concavo-convex structures that comes into contact with the webs.

8. The nozzle surface wiping device according to claim 6, wherein the feed holes are formed in two rows at each of the end parts on both sides in the width direction of the web, and wherein two rows of the concavo-convex structures are formed at each of the end parts on both sides in the winding shaft.

9. The nozzle surface wiping device according to claim 6, wherein the nozzle surface is wiped by relatively moving the wiping member and the liquid discharge head while the wiping member to which the saturated liquid amount of the cleaning liquid is applied is made to travel with the web transporting means.

10. The nozzle surface wiping device according to claim 1, wherein the information on the cleaning liquid application conditions includes information that determines the feed speed of the web by the web transporting unit, and a liquid supply amount per unit time of the cleaning liquid to be supplied from the cleaning liquid application unit to the web.

11. A head cleaning method of wiping a nozzle surface of a liquid discharge head with a wiping member, the method comprising:

a condition information holding step of determining cleaning liquid application conditions for applying respective saturated liquid amounts of a cleaning liquid to a plurality of types of wiping members, respectively, according to the types of the wiping members in advance, and of holding information on the cleaning liquid application conditions according to the types of the wiping members;

a type specifying step of specifying the type of a wiping member to be used for the wiping of the nozzle surface;

a condition determination step of determining the cleaning liquid application conditions corresponding to the type of the wiping member specified by the type specifying step;

a cleaning liquid application step of applying a saturated liquid amount of the cleaning liquid to the wiping member according to the cleaning liquid application conditions determined by the condition determination step; and a wiping step of bringing the wiping member, in a state where the saturated liquid amount of the cleaning liquid is applied thereto, into contact with the nozzle surface, thereby wiping the nozzle surface, wherein the wiping member is a beltlike web, and the web is transported by a web transporting means in a longitudinal direction of the web in the wiping step, wherein, in a case where a feed speed of the web is defined as v millimeters per second, a feed time of the web is defined as t seconds, a web width in a width direction orthogonal to the longitudinal direction of the web is defined w millimeters, a saturated absorbed liquid amount per unit area of the web is defined as C milliliters per square millimeters, and an application amount of the cleaning liquid is defined as L milliliters, the application amount of the cleaning liquid is brought to satisfy $L \geq v \times t \times w \times C$.

* * * * *